US010919551B2

(12) United States Patent
Ruhland et al.

(10) Patent No.: US 10,919,551 B2
(45) Date of Patent: Feb. 16, 2021

(54) METHOD AND SYSTEM FOR TRANSMITTING ENFORCEABLE INSTRUCTIONS IN VEHICLE CONTROL SYSTEMS

(71) Applicant: Wabtec Holding Corp., Wilmerding, PA (US)

(72) Inventors: Kristofer M. Ruhland, Cedar Rapids, IA (US); Karen A. Shaw, Cedar Rapids, IA (US); James L. Fenske, Marion, IA (US)

(73) Assignee: Wabtec Holding Corp., Wilmerding, PA (US)

( * ) Notice: Subject to any disclaimer, the term of this patent is extended or adjusted under 35 U.S.C. 154(b) by 163 days.

(21) Appl. No.: 16/110,415

(22) Filed: Aug. 23, 2018

(65) Prior Publication Data

US 2019/0092361 A1 Mar. 28, 2019

Related U.S. Application Data

(63) Continuation of application No. 14/032,710, filed on Sep. 20, 2013, now Pat. No. 10,081,378.

(Continued)

(51) Int. Cl.
*B61L 27/00* (2006.01)
*B61L 3/00* (2006.01)

(Continued)

(52) U.S. Cl.
CPC ..... *B61L 27/0005* (2013.01); *B61L 3/008* (2013.01); *B61L 3/125* (2013.01); *B61L 15/0063* (2013.01);

(Continued)

(58) Field of Classification Search
CPC ..... B61L 27/0005; B61L 3/008; B61L 3/125; B61L 15/0063; B61L 23/041; B61L 27/0088

(Continued)

(56) References Cited

U.S. PATENT DOCUMENTS 5,805,797 A * 9/1998 Sato ..... B61L 3/008 714/48
8,714,494 B2 * 5/2014 Weber ..... B61L 15/0063 246/131
2004/0019696 A1 * 1/2004 Scott ..... H04L 29/06 709/242
2004/0093196 A1 * 5/2004 Hawthorne ..... B61L 15/0072 703/8

(Continued)

FOREIGN PATENT DOCUMENTS

KR 101039787 B1 6/2011

OTHER PUBLICATIONS

Hartong, Mark W., "Secure Communications Based Train Control (CBTC) Operations", 2009, pp. 1-164, Spring Semester 2009, George Mason University, Fairfax, VA.

(Continued)

*Primary Examiner* — Peter D Nolan
*Assistant Examiner* — Wae L Louie
(74) *Attorney, Agent, or Firm* — Mary D. Lawlor; The Small Patent Law Group LLC

(57) ABSTRACT

A method and a system for transmitting enforceable instructions in a vehicle control (VC) system includes receiving, by a cyclic redundancy check (CRC) calculator, at least one enforceable instruction from vehicle systems. The CRC calculator calculates at least one enforceable instruction CRC based at least partly on the at least one enforceable instruction and transmits the at least one enforceable instruction CRC to a back office server of the VC system and/or an (Continued)

on-board system of a vehicle. Methods for cyclic redundancy check (CRC) hazard mitigation in a vehicle control (VC) system and verifying enforceable instruction data on-board a vehicle are also disclosed.

20 Claims, 20 Drawing Sheets

Related U.S. Application Data

(60) Provisional application No. 61/703,531, filed on Sep. 20, 2012.

(51) Int. Cl.
*B61L 15/00* (2006.01)
*B61L 3/12* (2006.01)
*B61L 23/04* (2006.01)

(52) U.S. Cl.
CPC ..... *B61L 23/041* (2013.01); *B61L 27/0088* (2013.01)

(58) Field of Classification Search
USPC ..... 701/19
See application file for complete search history.

(56) References Cited

U.S. PATENT DOCUMENTS

2004/0230982 A1* 11/2004 Wookey ..... G06Q 10/00 718/106
2005/0205718 A1* 9/2005 Tsai ..... B61L 23/00 246/1 R
2006/0022063 A1* 2/2006 Tsai ..... B61L 29/24 238/8
2011/0075641 A1* 3/2011 Siriwongpairat ..... H04W 4/12 370/337
2011/0276285 A1* 11/2011 Alexander ..... B61L 1/20 702/58
2012/0123617 A1* 5/2012 Noffsinger ..... B61L 15/0027 701/19
2014/0014784 A1* 1/2014 Brown ..... B61L 15/0054 246/182 B
2014/0107875 A1* 4/2014 Beyer ..... H04L 63/0876 701/19
2014/0172205 A1* 6/2014 Ruhland ..... B61L 3/125 701/19

OTHER PUBLICATIONS

Kunifuji, Takashi et al., "A Novel Railway Signal Control System Based on the Internet Technology and an Assurance Technology", IEEE Computer Society, 2008, The 28th International Conference on Distributed Computing Systems Workshops, Japan.

* cited by examiner

Note: G BOS requests the locomotive configuration and the IC3 Composite CRC at the same time. The order of requesting the locomotive configuration and IC3 Composite CRC does not matter.

Table 1 CRC Behaviors

| Message sent to on-board | G BOS Mode | Dataset CRC | IC3 Composite CRC | IC3 Authority or Void CRC | IC3 Bulletin or Void CRC | Onboard Response | G BOS Response |
|---|---|---|---|---|---|---|---|
| Movement Authority Dataset (01051) | n/a | n/a | n/a | match | n/a | existing | existing |
| Movement Authority Dataset (01051) | n/a | n/a | n/a | no match | n/a | Set sub to "non-sync", Send 02052 message with enumeration for IC3 Authority CRC mismatch | EV, CFG response |
| Movement Authority Void | n/a | n/a | n/a | match | n/a | existing | existing |
| Movement Authority Void (01053) | n/a | n/a | n/a | no match | n/a | Set sub to "non-sync", Send 02053 message with enumeration for IC3 Authority Void CRC mismatch | EV, CFG response |
| Bulletin Dataset (01041) | n/a | n/a | n/a | n/a | match | existing | existing |
| Bulletin Dataset (01041) | n/a | n/a | n/a | n/a | no match | Set sub to "non-sync", Send 02042 message with enumeration for IC3 Bulletin CRC mismatch | EV, CFG response |
| Bulletin Cancellation (01043) | n/a | n/a | n/a | n/a | match | existing | existing |
| Bulletin Cancellation (01043) | n/a | n/a | n/a | n/a | no match | Set sub to "non-sync", Send 02043 message with enumeration for IC3 Bulletin Void CRC mismatch | EV, CFG response |
| Office Segment Poll (01021) | Explicit Control | match | match | n/a | n/a | existing | existing |
| Office Segment Poll (01021) | Explicit Control | match | no match | n/a | n/a | send 02020 message to request new poll, NAK w/02021 message if CRC in 2nd poll mismatches, set sub to "non-sync" | EV, CFG response |
| Office Segment Poll (01021) | Explicit Control | no match | not checked | n/a | n/a | Resync with BOS, request another poll. If condition persists set sub to "non-sync" | Sync w/onboard |
| Office Segment Poll (01021) | Non-explicit Control | match | not checked | n/a | n/a | Resync with BOS, request another poll. If condition persists set sub to "non-sync" | existing |
| Office Segment Poll (01021) | Non-explicit Control | no match | not checked | n/a | n/a | existing | existing |
| Office Segment Poll (01021) | Synchronized | not checked | not checked | n/a | n/a | existing | existing |

FIG. 5C

* IC3 computed CRC over the individual Authority
** IC3 computed CRC over all Bulletin and Authority CRCs for a Train ID per subdivision/district ^ A single Replicator is shown for clarity. Wabtec is proposing two, one between Railroad Systems and IC3/BOS Instance and the other between On-board and IC3/BOS Instance.

METHOD AND SYSTEM FOR TRANSMITTING ENFORCEABLE INSTRUCTIONS IN VEHICLE CONTROL SYSTEMS

CROSS REFERENCE TO RELATED APPLICATIONS

This application is a continuation of U.S. patent application Ser. No. 14/032,710, filed Sep. 20, 2013, which claims the benefit of U.S. Provisional Application No. 61/703,531, filed Sep. 20, 2012, the disclosures of which are hereby incorporated in their entirety by reference.

BACKGROUND OF THE INVENTION

Field of the Invention

Preferred and non-limiting embodiments are related to positive train control (PTC) systems and, in particular, to a method and system for transmitting enforceable instructions in PTC systems.

Description of Related Art

There are potential hazards associated with conventional designs of a Back Office Server (BOS) segment in conventional positive train control (PTC) systems. For example, various hazards have been identified and are associated with the manner in which conventional PTC systems transform and transfer enforceable instruction data to an on-board system after the enforceable instruction data is received from a computer aided dispatch (CAD) in Railroad Systems. An enforceable instruction is a bulletin or authority issued to a train by a CAD. In particular, two identified hazards include: (1) the BOS normalization process may cause enforceable instruction data received by the on-board system to differ from the enforceable instruction data that was sent by the CAD; and (2) the BOS may not associate an enforceable instruction with the correct train(s).

The first hazard is associated with the manner in which the PTC system handles enforceable instruction data after the enforceable instruction data is received from the CAD. A conventional process for issuing an enforceable instruction from a CAD system to the on-board system is described below and illustrated in FIG. 1. The CAD sends an enforceable instruction to a geographic BOS (G BOS) containing safety critical information with a railroad (RR) message cyclic redundancy check (CRC) over the entire enforceable instruction message content. The G BOS receives and validates the message using the RR message CRC. The G BOS normalizes CAD-provided enforceable instruction data unique to each railroad into a common format. The G BOS constructs and sends a Bulletin Dataset message (message 01041) or a Movement Authority Dataset message (message 01051) to the on-board system by assigning the enforceable instruction to an on-board system based on locomotive and train identifications in the enforceable instruction and stored associations (e.g., Train ID to Locomotive ID association and subdivision/district polling); constructs a dataset message (Bulletin Dataset (01041) or Movement Authority Dataset (01051) message) and includes a BOS enforceable instruction (MD) CRC with the message; calculates a hash-based message authentication code (HMAC) over the entire message; and sends the dataset message to the on-board system. The on-board system receives and validates the dataset message (Bulletin Dataset (01041) or Movement Authority Dataset (01051) message) by authenticating the message using the message HMAC and validating individual fields in the message, as well as the BOS MD CRC.

One potential hazard associated with G BOS conversion of safety critical MD data (shown as "Hazard" in FIG. 1) is that the on-board system enforces incorrect safety critical MD data due to MD data received by the on-board segment differing from the data sent by CAD. The G BOS normalization causes the MD data to be changed from the MD data that was initially sent by the CAD to the G BOS. Conventional PTC systems do not include a method or system for ensuring the integrity of the BOS segment transmission of enforceable instructions to locomotives.

A second hazard is that the G BOS may not associate an enforceable instruction with the correct train(s). An incorrect association results in the on-board system having the wrong set of enforceable instruction data and enforcing incorrect safety critical data. FIG. 2 shows a conventional enforceable instruction delivery method with the second hazard identified.

SUMMARY OF THE INVENTION

Generally provided is a method and system for transmitting enforceable instructions in positive train control (PTC) systems that addresses or overcomes some or all of the deficiencies and drawbacks associated with existing methods and systems for transmitting enforceable instructions in PTC systems, including, but not limited to, the I-ETMS® of Wabtec Corp.

Preferably, provided is an independent process used to verify geographic back office server (G BOS) normalization and train association of enforceable instruction data. The process may be implemented or executed on any specially-programmed processor or computer in any suitable location or environment. The process generates data used by an on-board system to ensure that the G BOS delivers correct enforceable instruction data to the correct trains. The process, e.g., an Individual and Composite CRC Calculator (IC3), independently, and in one preferred and non-limiting embodiment, creates two types of CRCs used by on-board: Individual MD CRCs and the IC3 Composite CRC. Individual MD CRCs are used within the train control system to ensure each enforceable instruction is correct when received by on-board. The IC3 Composite CRC is used within the train control system to ensure that the on-board has the correct set of enforceable instructions.

The term or phrase "enforceable instructions" relates to mandatory directives, permissive enforceable instructions, restrictive enforceable instructions, enforceable instructions to the locomotive (e.g., the on-board system of the locomotive), or any combination thereof. Accordingly, while the terms or phrases "mandatory directive" or "MD" may be used hereinafter, the described methods and systems are equally useful in connection with any type, form, or format of enforceable instruction. In one preferred and non-limiting embodiment, the enforceable instructions are in the form of or include mandatory directive information and data.

Preferably, provided is a method and system for transmitting enforceable instructions in PTC systems which mitigate hazards that could occur in the transmission of the enforceable instructions from railroad systems through a back office server (BOS) to a locomotive (on-board system). Preferably, provided is a method and system for transmitting enforceable instructions in PTC systems that affect a PTC Office-Locomotive interface control document (ICD) and an on-board system and BOS segments of the PTC system, as well as introduces improved components to the BOS segment.

Preferably, provided is a method and system for ensuring: (1) electronic delivery of an enforceable instruction (authority or bulletin) to the correct train; and (2) that the enforceable instruction is intact (i.e., not changed from when the enforceable instruction was generated by a railroad's computer aided dispatch (CAD) system).

One advantage of preferred and non-limiting embodiments is that a need for redundant BOS segments to provide safety assurance and protection against hardware and software errors is obviated. Further, preferred and non-limiting embodiments including, for example, an individual and composite cyclic redundancy check (CRC) calculator (IC3), may be separate from and work with a BOS segment that takes disparate data from external systems and converts the disparate data to a common format for transmission to a locomotive. The IC3 works with the PTC system to ensure that data is not damaged, and that the data is received by the correct PTC-equipped locomotive. As used herein, the CRC calculator or IC3 may be in the form of a program or process that is executed or implemented on one or more specially-programmed computers, servers, systems, or the like.

According to a preferred and non-limiting embodiment, a method for transmitting enforceable instructions in a positive train control (PTC) system includes: receiving, by a cyclic redundancy check (CRC) calculator, at least one enforceable instruction from a railroad system; calculating, by the CRC calculator, at least one enforceable instruction CRC based at least partly on the at least one enforceable instruction; and transmitting, by the CRC calculator, the at least one enforceable instruction CRC to a back office server of the PTC system and/or an on-board system of a locomotive (e.g., directly to the locomotive or train).

The CRC calculator may be external to the railroad systems, and a computer aided dispatch in the railroad systems may include the CRC calculator. The at least one enforceable instruction may be a plurality of enforceable instructions, and the CRC calculator may calculate a plurality of individual enforceable instruction CRCs based at least partly on the plurality of enforceable instructions. The CRC calculator may calculate a composite enforceable instruction CRC based at least partly on a portion of the plurality of individual enforceable instruction CRCs associated with a train for a subdivision/district of a plurality of different subdivisions/districts of the PTC system. The at least one enforceable instruction may be a plurality of enforceable instructions, and the CRC calculator may calculate a composite enforceable instruction CRC based at least partly on a portion of the plurality of enforceable instructions associated with a train for a subdivision/district of a plurality of different subdivision/districts of the PTC system.

The CRC calculator may be separate from and not share any components or data storage with the back office server. The at least one enforceable instruction CRC may include an authority data CRC, a bulletin data CRC, an authority void data CRC, and/or a bulletin void data CRC. A replicator may replicate a message including the at least one enforceable instruction sent by the railroad systems to the back office system. The CRC calculator may receive the replicated message. The CRC calculator may convert the at least one enforceable instruction into a neutral data format that is the same for each railroad of a plurality of different railroads, and calculate the at least one enforceable instruction CRC based at least partly on the at least one enforceable instruction in the neutral data format.

In one preferred and non-limiting embodiment, the back office server receives the at least one enforceable instruction from the railroad systems; converts the at least one enforceable instruction into a normalized format, wherein the normalized format is different from the neutral format; calculates at least one BOS enforceable instruction CRC based at least partly on the at least one enforceable instruction in the normalized format; receives the at least one enforceable instruction CRC from the CRC calculator; and transmits the at least one BOS enforceable instruction CRC and the at least one enforceable instruction in the normalized format with the at least one enforceable instruction CRC to an on-board system.

The on-board system may receive the at least one BOS enforceable instruction CRC, the at least one enforceable instruction in the normalized format, and the at least one enforceable instruction CRC; convert the at least one enforceable instruction received from the back office server into the neutral data format; calculate at least one on-board enforceable instruction CRC based at least partly on the at least one enforceable instruction in the neutral data format; and compare the at least one enforceable instruction CRC received from the back office server to at least one on-board calculated enforceable instruction CRC to validate the at least one enforceable instruction CRC.

The on-board system may validate the at least one enforceable instruction CRC if the at least one enforceable instruction CRC matches the at least one on-board calculated enforceable instruction CRC and set an associated subdivision/district of a plurality of different subdivisions/districts of the PTC system to a non-synchronized state if the at least one enforceable instruction CRC does not match the at least one on-board calculated enforceable instruction CRC.

According to another preferred and non-limiting embodiment, a system for transmitting enforceable instructions in a positive train control (PTC) system includes a server computer connected to at least one network. The server computer is programmed, adapted, or configured to receive at least one enforceable instruction from railroad systems; calculate at least one enforceable instruction CRC based at least partly on the at least one enforceable instruction; and transmit the enforceable instruction CRC to a back office server computer of the PTC system.

According to still another preferred and non-limiting embodiment, a computer program stored on a computer memory and executing on a processor which, when used on a computer apparatus causes the processor to execute steps of a method and/or implement a method for transmitting enforceable instructions in a positive train control (PTC) system. The method includes: receiving at least one enforceable instruction from railroad systems; calculating at least one enforceable instruction CRC based at least partly on the at least one enforceable instruction; and transmitting the enforceable instruction CRC to a back office server of the PTC system.

According to a preferred and non-limiting embodiment, a method for cyclic redundancy check (CRC) hazard mitigation in a positive train control (PTC) system includes: receiving, by a CRC calculator, at least one enforceable instruction from railroad systems; calculating, by the CRC calculator, an individual enforceable instruction CRC based at least partly on the at least one enforceable instruction; and transmitting, by the CRC calculator, the individual enforceable instruction CRC to a back office server.

According to another preferred and non-limiting embodiment, a method for cyclic redundancy check (CRC) hazard mitigation includes: receiving, by a CRC calculator, a plurality of enforceable instructions from railroad systems; calculating, by the CRC calculator, a composite enforceable instruction CRC based at least partly on a portion of the plurality of enforceable instructions associated with a train for a subdivision/district of a plurality of different subdivision/districts of the PTC system; and transmitting, by the CRC calculator, the composite enforceable instruction CRC to a back office server.

According to still another preferred and non-limiting embodiment, a method for cyclic redundancy check (CRC) hazard mitigation includes: calculating, by a computer aided dispatch in railroad systems, at least one enforceable instruction CRC based at least partly upon at least one enforceable instruction; and transmitting, by the computer aided dispatch, the at least one enforceable instruction CRC with the at least one enforceable instruction to a back office server.

In another preferred and non-limiting embodiment, provided is a method for verifying enforceable instruction data on-board a train, including: receiving, at an on-board system on the train from a back office server, enforceable instruction data and at least one enforceable instruction CRC comprising at least one of the following: an authority data CRC, a bulletin data CRC, an authority void CRC, a bulletin void CRC, a composite CRC, or any combination thereof, wherein the at least one enforceable instruction CRC is generated based at least partially on at least one enforceable instruction issued from dispatch; generating, on the on-board system, an on-board CRC based at least partially on the enforceable instruction data; and verifying, on the on-board system, at least a portion of the enforceable instruction data based at least partially on the at least one enforceable instruction CRC and the on-board CRC.

These and other features and characteristics of the present invention, as well as the methods of operation and functions of the related elements of structures and the combination of parts and economies of manufacture, will become more apparent upon consideration of the following description and the appended claims, if any, with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, if any, the singular form of "a", "an", and "the" include plural referents unless the context clearly dictates otherwise.

BRIEF DESCRIPTION OF THE DRAWINGS

FIG. 5C is a table showing PTC systems behaviors according to a preferred and non-limiting embodiment;

DETAILED DESCRIPTION OF THE PREFERRED EMBODIMENT(S)

Figure 1:
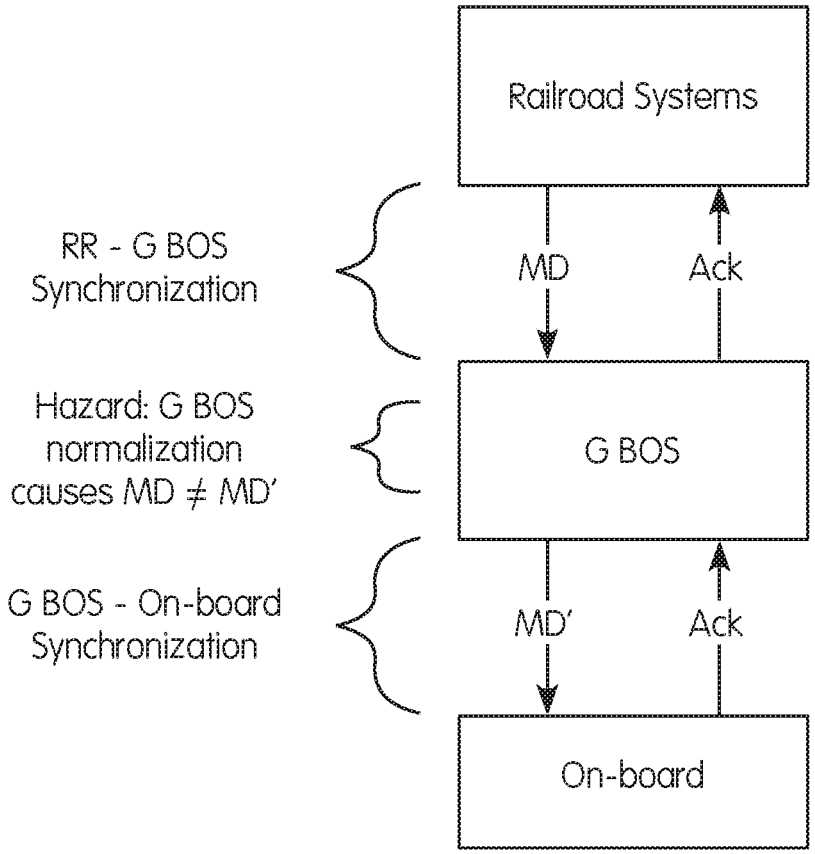
FIG. 1 (Prior Art)
FIG. 1 is a flow chart illustrating a geographic Back Office Server (G BOS) normalization hazard in a conventional positive train control (PTC) system.
Figure 2:
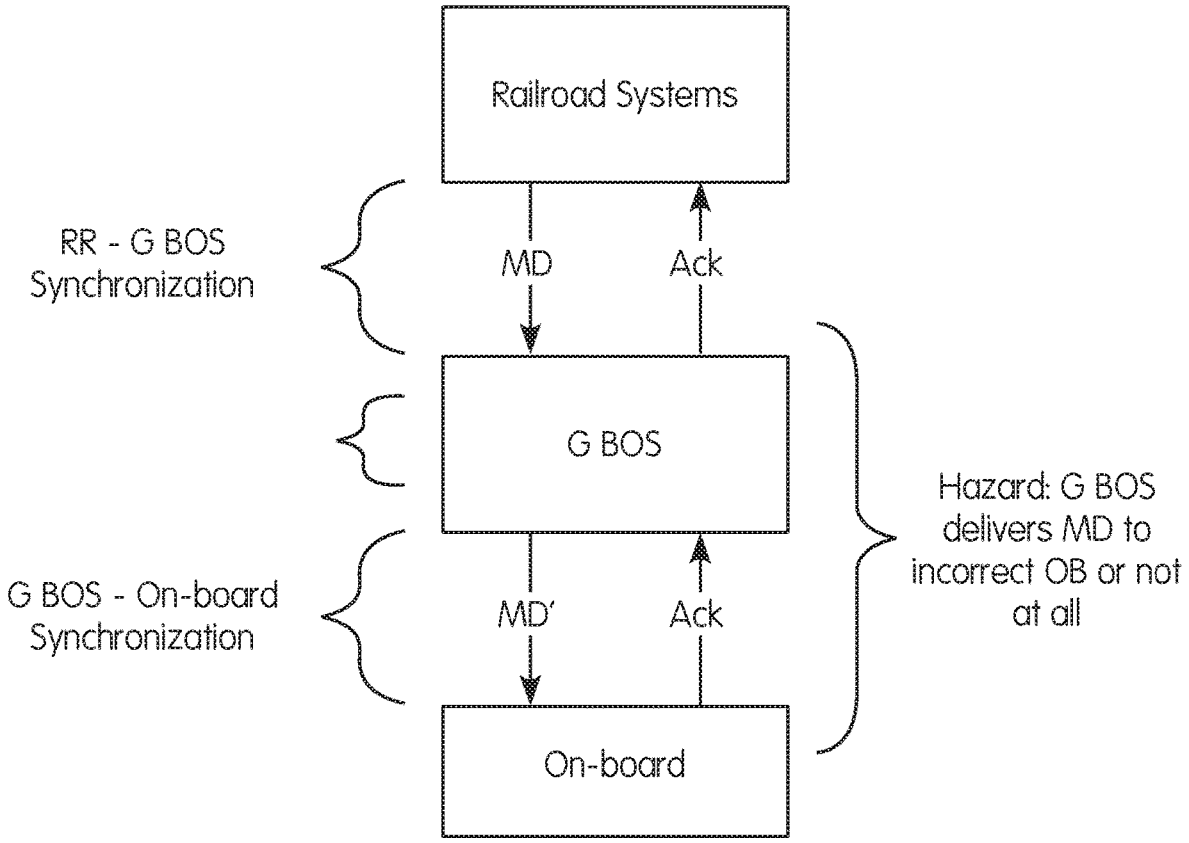
FIG. 2 (Prior Art)
FIG. 2 is a flow chart illustrating a G BOS association hazard in a conventional PTC system.

For purposes of the description hereinafter, the terms "end", "upper", "lower", "right", "left", "vertical", "horizontal", "top", "bottom", "lateral", "longitudinal" and derivatives thereof shall relate to the invention as it is oriented in the drawing figures. It is to be understood that the invention may assume various alternative variations and step sequences, except where expressly specified to the contrary. It is also to be understood that the specific devices and processes illustrated in the drawings, and described in the following specification, are simply exemplary embodiments of the invention. Hence, specific dimensions and other physical and/or processing characteristics related to the embodiments disclosed herein are not to be considered as limiting.

As used herein, the terms "communication" and "communicate" refer to the receipt or transfer of one or more signals, messages, commands, or other type of data. For one unit or component to be in communication with another unit or component means that the one unit or component is able to directly or indirectly receive data from and/or transmit data to the other unit or component. This can refer to a direct or indirect connection that may be wired and/or wireless in nature. Additionally, two units or components may be in communication with each other even though the data transmitted may be modified, processed, routed, and the like, between the first and second unit or component. For example, a first unit may be in communication with a second unit even though the first unit passively receives data, and does not actively transmit data to the second unit. As another example, a first unit may be in communication with a second unit if an intermediary unit processes data from one unit and transmits processed data to the second unit. It will be appreciated that numerous other arrangements are possible.

Table 1 below defines various acronyms used in the description.

TABLE 1

| Acronym | Description |
|---|---|
| BOS | Back Office Server or Segment |
| IC3 | Individual and Composite CRC Calculator |
| CFG | Configurable Item |
| CAD | Computer Aided Dispatch |
| CRC | Cyclic Redundancy Check |
| G BOS | Geographic BOS |
| HMAC | Hash-based Message Authentication Code |
| ICD | Interface Control Document |
| ID | Identifier |

TABLE 1-continued

| Acronym | Description |
|---|---|
| I-ETMS | Interoperable Electronic Train Management System |
| JRST | Joint Rail Safety Team |
| MD | Mandatory Directive and/or Enforceable Instruction |
| PTC | Positive Train Control |
| WRE | Wabtec Railway Electronics |

Table 2 below defines various terms used in the description.

TABLE 2

| Term | Description |
|---|---|
| CRC | A checksum function used to check data integrity |
| MD CRC | General term used to refer to any or all of the four CRCs generated by railroad systems for inclusion in an enforceable instruction or enforceable instruction void. |
| Mandatory Directive | A bulletin or authority issued to a train by a CAD, and an example of an Enforceable Instruction |
| BOS MD CRC | The CRC calculated by BOS to represent enforceable instruction data included in enforceable instruction messages. |
| Dataset CRC | The CRC calculated over the CRCs of fields in the enforceable instruction messages. Calculated by G BOS and sent during the polling process. |
| HMAC | Appended to an Office - Locomotive message used to protect the integrity of the message. |
| IC3 Authority CRC | The CRC calculated by IC3 over authority data received from CAD. |
| IC3 Authority Void CRC | The CRC calculated by IC3 over authority void data received from CAD. |
| IC3 Bulletin CRC | The CRC calculated by IC3 over bulletin data received from CAD. |
| IC3 Bulletin Void CRC | The CRC calculated by IC3 over bulletin cancellation data received from CAD. |
| IC3 Composite CRC | The CRC calculated by IC3 over the Individual MD CRCs of the non-normalized enforceable instruction data for a train for a subdivision/district. |
| Individual and Composite CRC Calculator (IC3) | A process that independently generates the IC3 Authority CRC, IC3 Bulletin CRC, IC3 Authority Void CRC, IC3 Bulletin Void CRC, and the IC3 Composite CRC for verification by on-board. |
| Individual MD CRC | A generic name for the following CRCs: IC3 Authority CRC, IC3 Authority Void CRC, IC3 Bulletin CRC, IC3 Bulletin Void CRC. |
| Enforceable instruction | A bulletin or authority issued by a Railroad System. |
| Normalized Data | The common format that BOS converts messages from each Railroad System to. |
| Railroad Systems | Term used to include any sending/receiving system on the railroad side of a communication path, such as central dispatch, computer aided dispatch, or the like. |
| RR Message CRC | The CRC appended to a message sent by Railroad Systems to BOS that is used to protect the integrity of the message. |

One or more of the following assumptions may be considered and/or made in connection with preferred and non-limiting embodiments described herein: (1) a Railroad System sends all enforceable instructions with limits in PTC territory to a BOS; (2) a Railroad System and the interface between the Railroad System and a BOS are configured for the BOS to detect missed enforceable instruction messages in a timely manner; (3) a Railroad System voids an authority or bulletin by explicit message; (4) corruption of message data in transit between a CAD in the Railroad System and a BOS is detected as invalid; (5) corruption of message data in transit between an on-board system and a BOS is detected as invalid; (6) receipt by a BOS of messages from an on-board system is not guaranteed; (7) receipt by an on-board system of messages from a BOS is not guaranteed; (8) when a Railroad System issues an enforceable instruction with a locomotive ID and no train ID, the enforceable instruction applies to the locomotive ID regardless of train ID; (9) when a Railroad System issues an enforceable instruction with a train ID and no locomotive ID, the enforceable instruction applies to all locomotive IDs associated with that train ID; (10) when a Railroad System issues an enforceable instruction with one or more locomotive IDs and one or more train IDs, the enforceable instruction applies to any locomotive ID in the enforceable instruction that is associated with any train ID in the enforceable instruction; (11) when a Railroad System issues an enforceable instruction with no locomotive ID and no train ID, the enforceable instruction applies to all locomotive IDs and train IDs registering for polling for the associated subdivision/district; (12) when a Railroad System issues an enforceable instruction with no locomotive IDs and a list of excluded train IDs, the enforceable instruction applies to all locomotive IDs associated with train IDs not listed as excluded; and (13) Railroad Systems do not use data from a PTC system track database when issuing an enforceable instruction.

An individual and/or composite cyclic redundancy check (CRC) method and system (e.g., calculator, processor, program, and the like) are described in more detail below with respect to FIGS. 3-5, and in certain preferred and non-limiting embodiments. An independent process may be used to verify G BOS normalization and train association of enforceable instruction data. Each G BOS may be associated with a particular geographic region, e.g., a particular subdivision/district of a plurality of different subdivisions/districts of the PTC system. The independent process generates data used by the on-board system to ensure that the G BOS delivers correct enforceable instruction data to the correct trains. In one preferred and non-limiting embodiment, the independent process or Individual and Composite CRC Calculator (IC3), independently creates two types of CRCs used by the on-board system, namely individual enforceable instruction (MD) CRCs and an IC3 Composite CRC. The IC3 does not affect operations of the Railroad Systems. Individual MD CRCs are used within the PTC system (e.g., the I-ETMS® of Wabtec Corp.) to ensure each enforceable instruction data is correct when received by the on-board system. The IC3 Composite CRC is used within the PTC system to ensure that the on-board system has the correct set of enforceable instructions. In one preferred and non-limiting embodiment, the IC3 does not share any components or data storage with the G BOS. In other preferred and non-limiting embodiments, the IC3 process (or any of the method or processing steps discussed herein) can be implemented or executed on any specially-programmed computer, server, and/or processor, and this processor or computer may be located in or integrated with a central system, a remote system, a server system, a network system, an on-board system, or any combination thereof.

With respect to Individual MD CRCs, and in one preferred and non-limiting embodiment, the IC3 generates Individual MD CRCs calculated over defined sets of safety critical enforceable instruction data. For example, four Individual MD CRCs may be calculated, including: an authority data CRC (IC3 Authority CRC), a bulletin data CRC (IC3 Bulletin CRC), an authority void CRC (IC3 Authority Void CRC), and a bulletin void CRC (IC3 Bulletin Void CRC). Each Individual MD CRC represents data for an Individual enforceable instruction, including voids. Authority and bulletin data each have a CRC to ensure the G BOS does not alter safety critical enforceable instruction data as the G BOS transfers the data to the on-board system. Authority and bulletin voids each have a CRC to ensure that the G BOS transfers the correct reference number associated with a void. The Individual MD CRCs ensure that G BOS normalization of a Railroad System (of which there are normally multiple, different Railroad Systems and/or multiple, different railroads) enforceable instruction data does not alter the data.

Figure 3A:
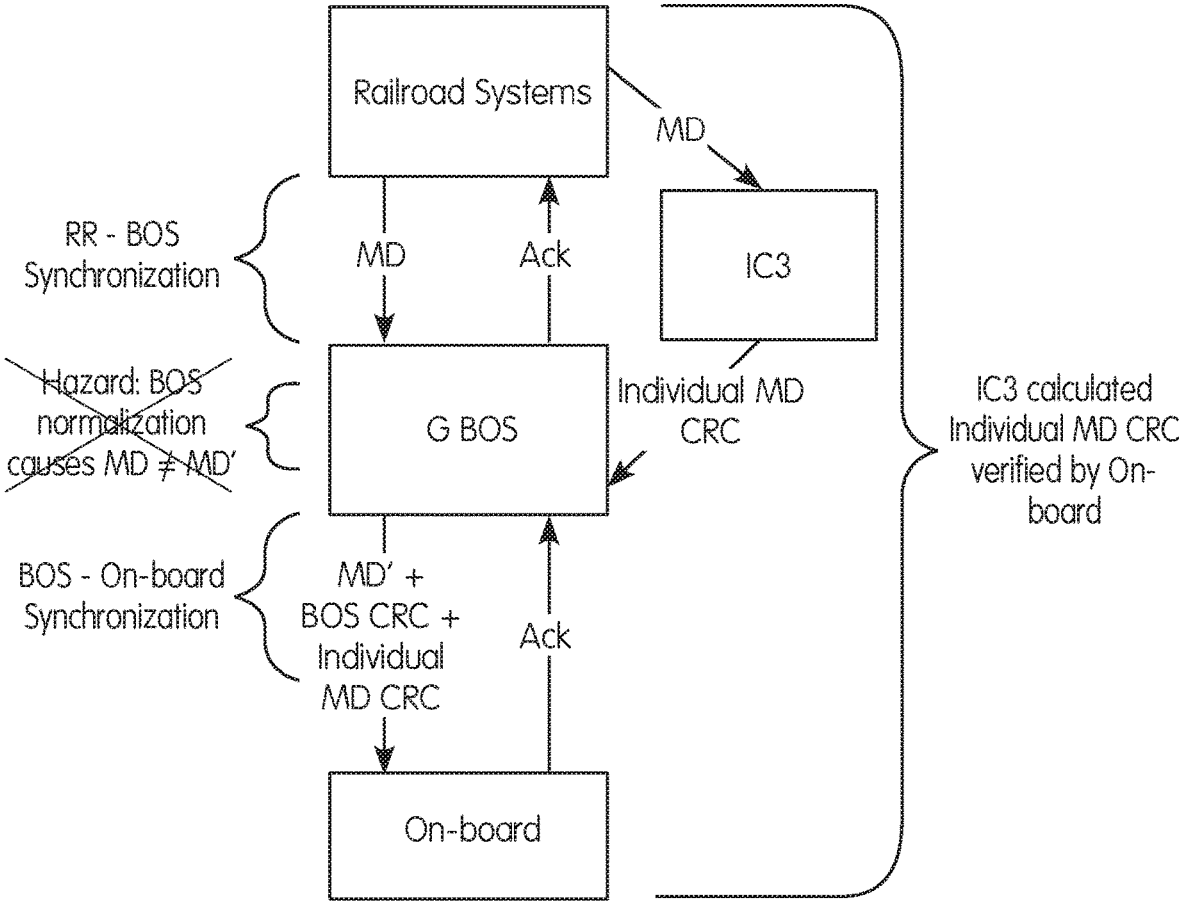
FIG. 3A is a flow chart illustrating a method and system for individual cyclic redundancy check (CRC) hazard mitigation according to a preferred and non-limiting embodiment.

FIG. 3A is a flow chart illustrating a method and system for individual CRC hazard mitigation according to a preferred and non-limiting embodiment. To calculate the Individual MD CRCs, the IC3 receives messages sent to the G BOS from the on-board system and Railroad Systems (e.g., from a CAD in the Railroad System), as well as messages sent from the G BOS to the on-board system and Railroad Systems. In one preferred and non-limiting embodiment, a replicator process is used so that the IC3 receives the G BOS messaging. A replicator sends a copy of each locomotive and Railroad Systems message communicated to the G BOS and to the IC3. Because the IC3 parses Railroad Systems messages, it is unique to each railroad.

The IC3 receives an enforceable instruction in the replicated message, converts the data into a neutral format that is the same for all railroads, and calculates the associated Individual MD CRC. When the G BOS receives an enforceable instruction from Railroad Systems, the G BOS requests and waits for the Individual MD CRC from the IC3 before generating and sending the associated Office-Locomotive message. The IC3 accepts a class D connection from the G BOS process. The IC3 is responsible for receiving the Request Individual MD CRC from G BOS. When the IC3 receives the Request Individual MD CRC message, it calculates the IC3 Individual CRC over the enforceable instruction and populates and sends the Individual MD CRC message to G BOS. If the IC3 receives the Request Individual MD CRC message requesting a CRC for enforceable instruction for which it has not stored any data, the IC3 does not respond to the G BOS.

The G BOS converts the enforceable instruction data into a normalized format, which is different from the neutral format, and calculates a BOS MD CRC based at least partly on the normalized data of the enforceable instruction. After the G BOS has received the Individual MD CRC, the Individual MD CRC is added to the appropriate message with the normalized enforceable instruction and sent to the on-board system. The on-board system validates the Individual MD CRC in addition to all existing validity checks. The on-board system validates the Individual MD CRC by converting enforceable instruction data received from the BOS into the same neutral format used by the IC3, and calculating the CRC. If the G BOS alters the enforceable instruction or the Individual MD CRC, the on-board system detects the alteration through validation of the Individual MD CRC.

When the on-board system receives the enforceable instruction, the on-board system compares the Individual MD CRC in the message to an equivalent on-board calculated Individual MD CRC. The on-board system calculates the on-board Individual MD CRC based on the enforceable instruction data converted into the same neutral format used by the IC3. When the on-board system calculated Individual MD CRC does not match the IC3 calculated Individual MD CRC, the on-board system sends the appropriate confirmation message to the G BOS and becomes "non-synchronized" for the subdivision/district(s) associated with the mismatched Individual MD CRC. When the G BOS receives the confirmation message from the on-board system the G BOS takes a configured action. The Individual MD CRC verification process mitigates the hazards described above in connection with normalizing the enforceable instruction data.

Figure 3B:
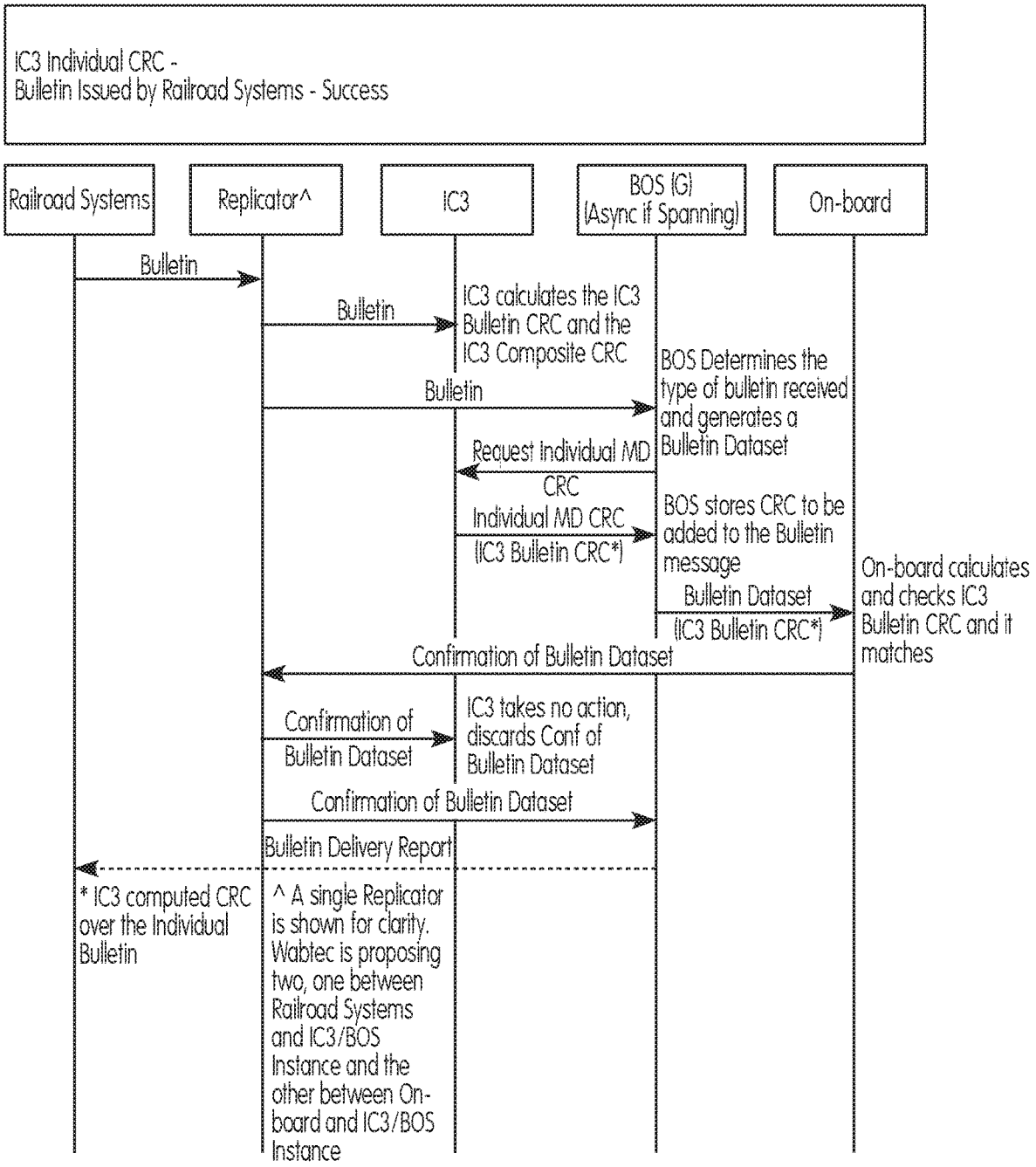
FIG. 3B is a signal/data flow chart illustrating a successful delivery of an enforceable instruction bulletin according to a preferred and non-limiting embodiment.

Still referring to FIG. 3A, when the on-board system verifies the Individual MD CRC for an enforceable instruction, the on-board system ensures safety critical data received from the Railroad System is not altered. FIG. 3B is a signal/data flow chart illustrating a successful delivery of an enforceable instruction bulletin according to a preferred and non-limiting embodiment. When safety critical data corruption is detected, the on-board system behaves safely by setting the associated subdivision/district to "non-synchronized" and performing associated existing behaviors. For example, the on-board system clearly indicates that it is not providing PTC protection while the train is operating in a "non-synchronized" subdivision/district through compliance with existing requirements for operating in a "non-synchronized" subdivision/district.

Figure 4A:
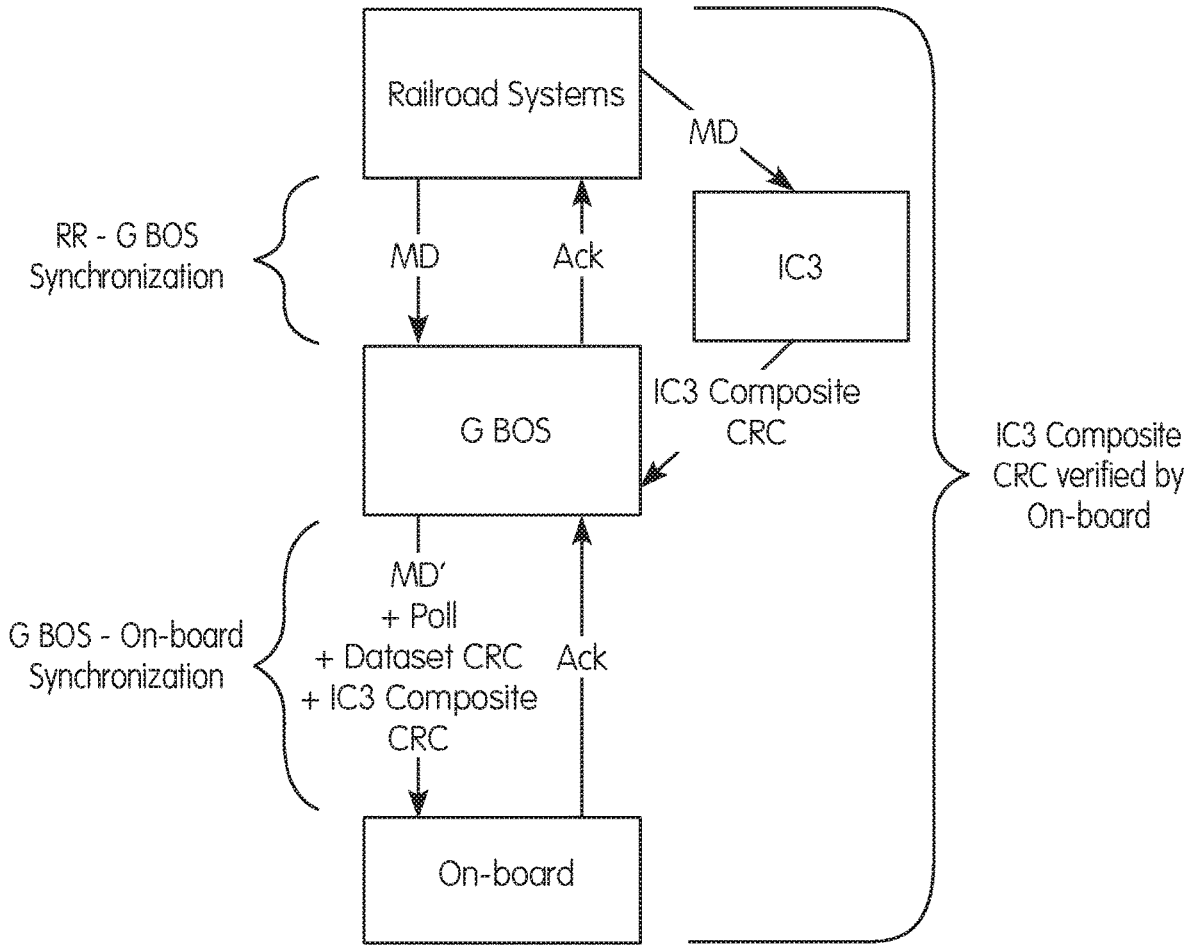
FIG. 4A is a flow chart illustrating a method and system for composite CRC hazard mitigation according to a preferred and non-limiting embodiment.
Figure 4B:
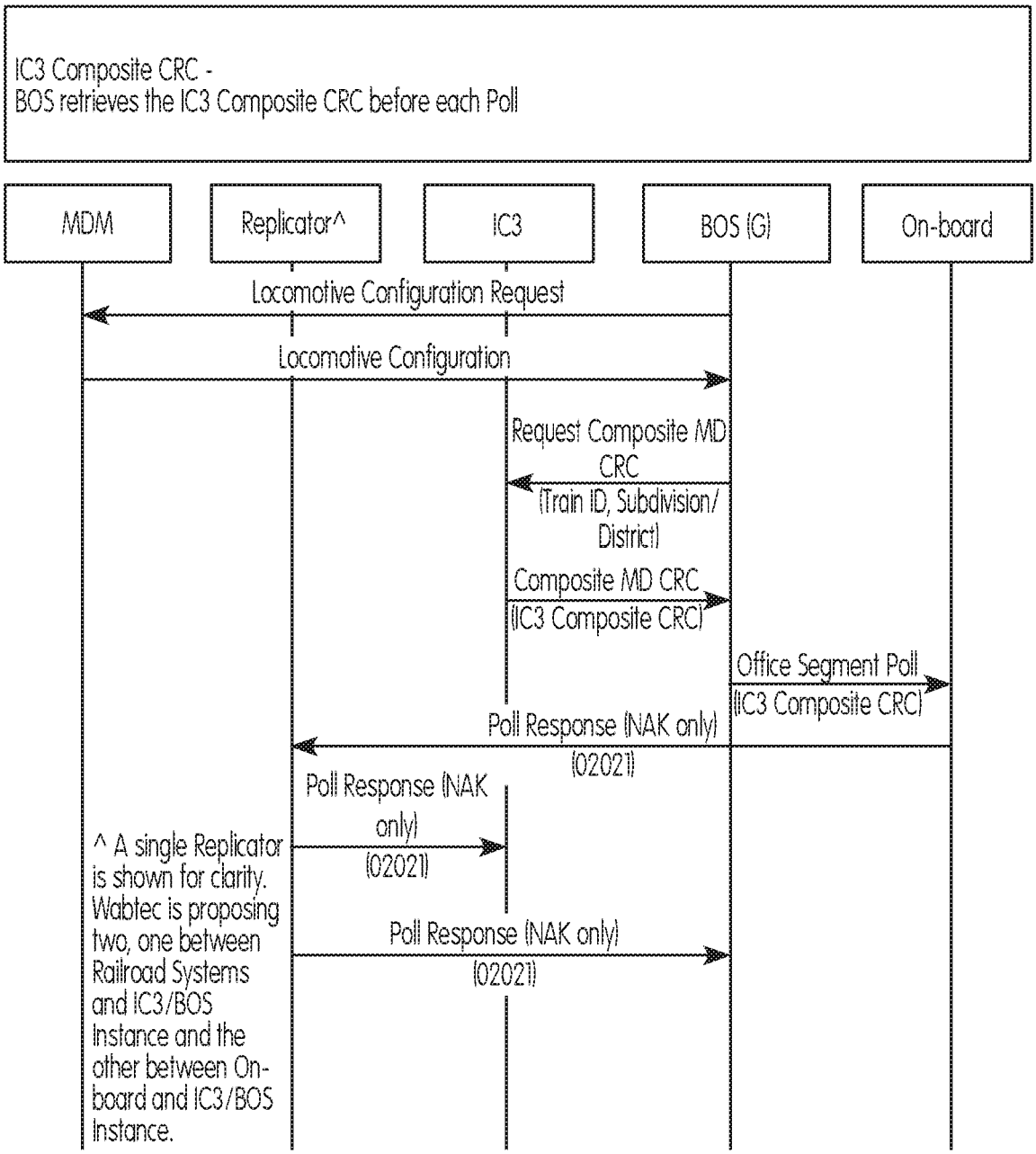
FIG. 4B is a signal/data flow chart illustrating a BOS retrieval of an IC3 Composite CRC before each poll.

FIG. 4A is a flow chart illustrating a method and system for composite CRC hazard mitigation according to a preferred and non-limiting embodiment. With respect to a composite CRC, and in one preferred and non-limiting embodiment, the independent process or IC3 independently generates the IC3 Composite CRC. The IC3 Composite CRC is added to the polling process and used as a requirement for the on-board system to be "synchronized" with the G BOS. FIG. 4B is a signal/data flow chart illustrating a BOS retrieval of an IC3 Composite CRC before each poll.

The IC3 calculates the IC3 Composite CRC for each train for each subdivision/district of the PTC system. The IC3 receives each message sent to a G BOS and each message sent from a G BOS from the replicator. The IC3 includes each enforceable instruction CRC stored for a train in the IC3 Composite CRC for a subdivision district. In this embodiment, the IC3 Composite CRC is calculated based on the Train ID, the subdivision district name, the IC3 Authority CRCs, and the IC3 Bulletin CRCs.

The IC3 Composite CRC represents the set of all bulletins and authorities that are associated with a train for a subdivision/district. The IC3 Composite CRC is calculated over data received from Railroad Systems that IC3 converts to a neutral format. The format that the IC3 uses is not the same as the BOS normalized format. Because the IC3 parses Railroad Systems messages, the IC3 is different for each railroad. The IC3 Composite CRC is calculated using the IC3 generated Individual MD CRCs described above. The IC3 Composite CRC is calculated over the Individual MD CRCs for all enforceable instructions stored for a train for a subdivision/district. To calculate the IC3 Composite CRC, the IC3 uses the Individual MD CRCs along with message data needed to associate the enforceable instructions with specific trains. To have the necessary message data, the IC3 receives messages sent to the G BOS from the on-board system and Railroad Systems, as well as messages sent from the G BOS to the on-board system and Railroad Systems.

During the G BOS-on-board polling process, the G BOS requests IC3 Composite CRCs for a train by subdivision/district from the IC3 and sends the IC3 Composite CRCs to the train. The IC3 receives the Request Composite CRC message from the G BOS. When the IC3 receives the Request Composite CRC message, the IC3 calculates an IC3 Composite CRC for each train for each subdivision/district requested. The IC3 populates the IC3 Composite CRC message with the IC3 Composite CRC for the requested train ID and each requested subdivision/district. When the IC3 receives the Synchronization Request message from the G BOS for a subdivision/district the IC3 discards enforceable instruction data associated with the subdivision/district identified in the message. The Synchronization Request message is a G BOS-CAD message that is replicated to the IC3.

Verification of an IC3 Composite CRC is an additional consideration for the on-board system to maintain synchronization with the G BOS for a subdivision/district. If there is a mismatch between the G BOS and the IC3 association of enforceable instructions with a train, the IC3 Composite CRC calculated by the on-board system does not match the IC3 Composite CRC received in the message.

Figure 4C:
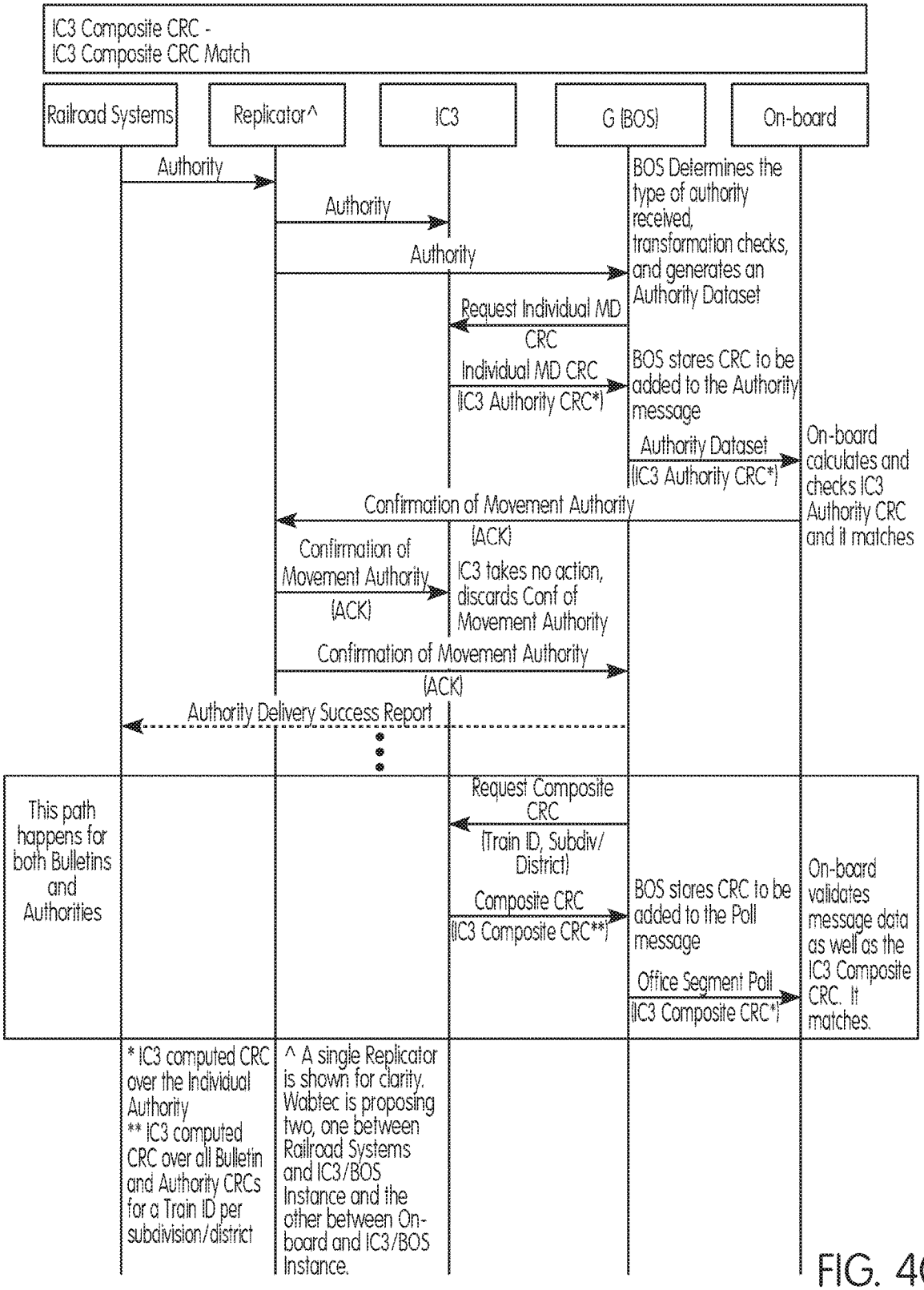
FIG. 4C is a signal/data flow chart illustrating a composite CRC match according to a preferred and non-limiting embodiment.

Still referring to FIG. 4A, a method and system including IC3 Composite CRC verification according to a preferred and non-limiting embodiment mitigates the hazards described in above in connection with associating enforceable instructions with trains. For example, the on-board system verifies two separate CRCs created by separate processes using dissimilar logic (i.e., a Dataset CRC calculated by the G BOS and an IC3 Composite CRC calculated by IC3). When the calculated CRCs match the received CRCs, there is a statistically significant probability [(probability MD set is correct=1−probability (corrupted message results in two dissimilar 32-bit CRCs being valid))] that the set of enforceable instructions on-board is correct. FIG. 4C is a signal/data flow chart illustrating a composite CRC match according to a preferred and non-limiting embodiment. When one of the calculated CRCs does not match the corresponding received CRC, the on-board system sets the associated subdivision/district to "non-synchronized" and acts safely using existing "non-synchronized" behaviors.

Figure 5A:
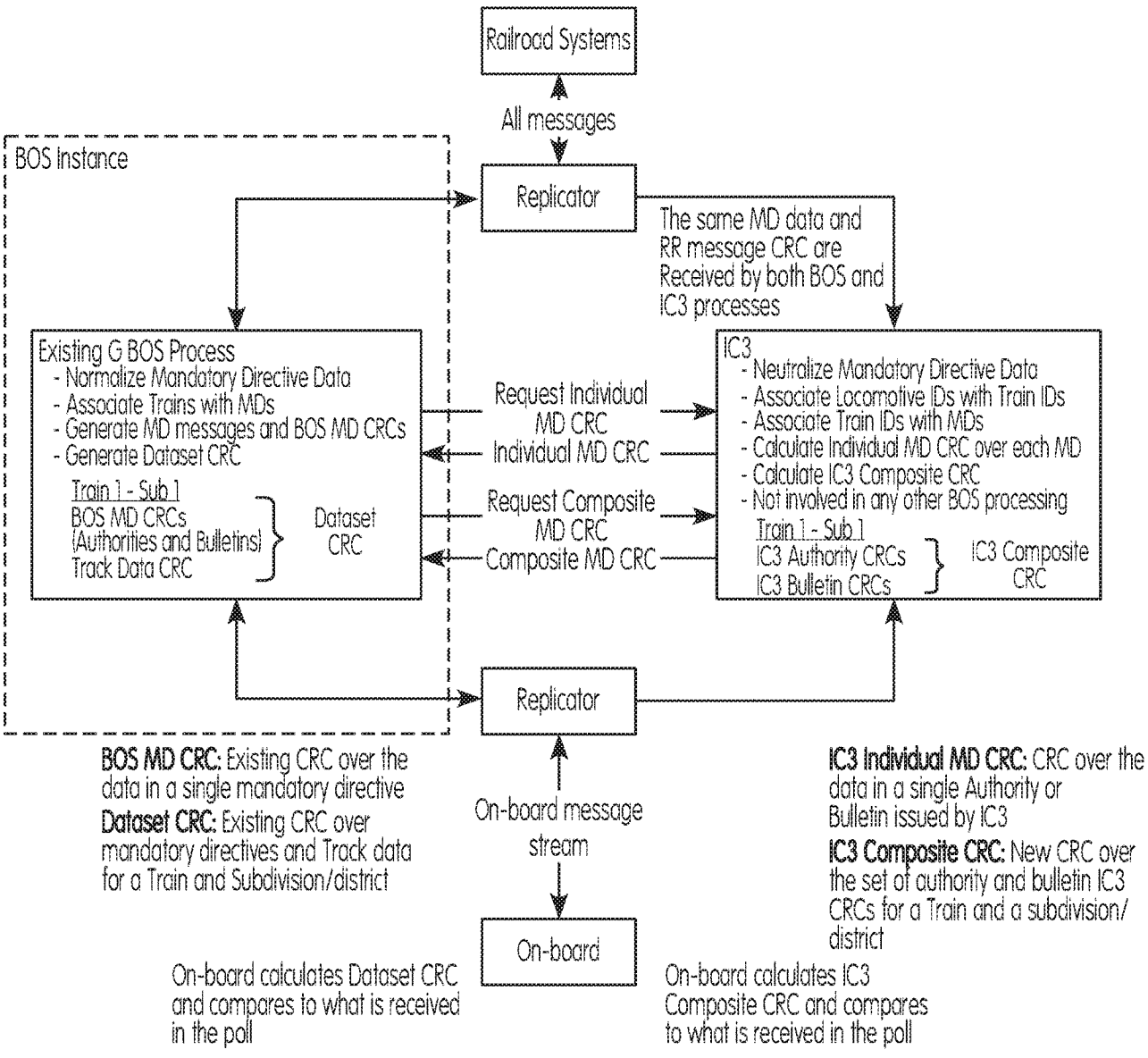
FIG. 5A is a flow chart illustrating a method and system for transmitting enforceable instructions in positive train control (PTC) systems according to a preferred and non-limiting embodiment.

FIG. 5A is a flow chart illustrating a method and system for transmitting enforceable instructions in PTC systems according to a preferred and non-limiting embodiment. In this preferred and non-limiting embodiment, the Individual and Composite CRC Calculator (IC3) is an independent software process that receives enforceable instruction related messaging both from Railroad Systems and the on-board system. The IC3 receives Railroad Systems and locomotive messages exchanged with a G BOS through message replicators. When the IC3 receives an enforceable instruction from Railroad Systems the IC3 generates the appropriate Individual MD CRC for the enforceable instruction. The IC3 uses the Individual MD CRC to update the IC3 Composite CRC for the associated train(s) and subdivision/district(s).

Figure 5B:
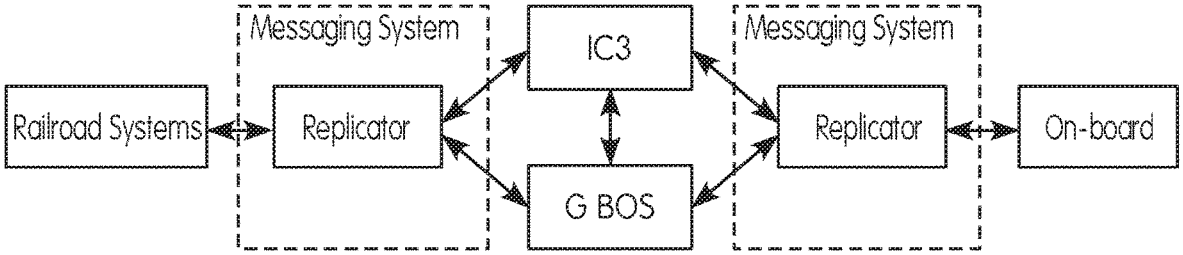
FIG. 5B is a block diagram illustrating a replicator according to a preferred and non-limiting embodiment.

FIG. 5B is a block diagram illustrating a replicator according to a preferred and non-limiting embodiment. The replicator is configured to replicate incoming and outgoing G BOS messages to IC3, as shown in FIG. 5B. Messages exchanged directly between IC3 and G BOS are not replicated nor are they passed through the replication function. The message replication function does not filter or modify messages. Depending on a railroad's messaging infrastructure, the replicator may be integrated into the messaging system or it may be a separate process that is associated with a single IC3 and G BOS pair. There may be two replicator processes, one for on-board communication and one for Railroad Systems communication. If the replicator fails to deliver enforceable instruction related messages to either IC3 or G BOS, the G BOS calculated Dataset CRC or IC3 calculated IC3 Composite CRC is detected as incorrect by the on-board system.

In this preferred and non-limiting embodiment, the IC3 may connect to the replicator via a class D interface. When the IC3 receives replicated messages, the IC3 validates that the message is not corrupt using the RR message CRC for Railroad Systems-G BOS messages or the HMAC for G BOS-on-board messages. The IC3 does not duplicate the extensive BOS message validation process but does validate fields used for calculating the Individual MD CRCs. When the IC3 determines that a message is invalid, the IC3 discards the message. The IC3 stores information from specified messages. The IC3 uses the message information to maintain associations between train IDs and enforceable instructions, associations between train IDs and locomotive IDs, and a determination if an enforceable instruction is required to be stored on-board. The IC3 uses the messages received from the on-board system to generate a train ID to locomotive ID association, as well as to determine the result of crew action for authorities (e.g., acknowledge/accept/reject). The IC3 ignores any message not required for determining which enforceable instructions should be on-board. The IC3 stores information in its own storage facility (e.g., a database) that is not accessible by G BOS. The IC3 stores the following Railroad System-G BOS message information: Authorities, Bulletins, Authority Voids, and Bulletin Voids/Cancels. The IC3 stores the following G BOS-on-board system message information: poll registration (train ID to locomotive ID association) and crew acknowledgement of enforceable instruction status (stored for authority acknowledge/accept/reject, but not for bulletins). The IC3 also monitors the G BOS-Railroad Systems messages via a replicator and uses the Synchronization Request message from G BOS to trigger the discarding of all enforceable instruction data associated with the subdivision/district received in the message.

When the G BOS receives an enforceable instruction from Railroad Systems, the G BOS processes the message using conventional BOS processing methods. The G BOS requests and waits for receipt of the Individual MD CRC prior to constructing and transmitting an enforceable instruction message to be sent to the on-board system. When issuing a poll to a train, the G BOS requests and waits for the IC3 Composite CRCs from IC3 for the train and subdivisions/districts to be included in the poll.

In another preferred and non-limiting embodiment, a Safety Assurance Concept may be a Diversity and Self Checking process implemented as a Self-Checking Code. Incorporation of the Individual MD CRC data into the BOS created enforceable instruction messages and the addition of the IC3 Composite CRC in the polling process enable the on-board segment an independent means or process of verifying that received data is correct and complete. Unique data sets (normalized versus neutralized), separate design specifications, and ICDs will allow for the creation of a diverse implementation.

Accordingly, in one preferred and non-limiting embodiment, a method and system for transmitting enforceable instructions in PTC systems includes: a process to calculate an IC3 Composite CRC representing all enforceable instructions associated with a train for a subdivision/district and an Individual MD CRC for each enforceable instruction; an IC3 Composite CRC field to the Office Segment Poll (01021) message; and a Poll Response (02021) message for the on-board to send to the G BOS in response to an Office Segment Poll (01021) message. The Poll Response message is used to indicate an IC3 Composite CRC mismatch after a second Office Segment Poll (01021) message is received by the on-board and the IC3 Composite CRC is still mismatched (NAK only). On-board processing of the Office Segment Poll (01021) message may be updated, and verification of the IC3 Composite CRC and generation of the Poll Response (02021) message may be included. A messaging interface between G BOS and IC3 is provided. A process to replicate messages exchanged between Railroad Systems and G BOS and between G BOS and on-board is provided. Replication may be bidirectional to and from Railroad Systems, and to and from the on-board system. Error code(s), event(s), and CFG(s) may be included in the G BOS to trigger a BOS action for subdivisions/districts based on the content received in a Poll Response (02021) message, the Confirmation of Movement Authority (02052) message, Confirmation of Movement Authority Void (02053) message, Confirmation of Bulletin Dataset (02042) message, and the Confirmation of Bulletin Cancellation (02043) message.

An IC3 instance may be provided for each G BOS process in a PTC system. The IC3 maintains a database of all currently issued bulletins and authorities and their Individual MD CRCs for the subdivision/district that the G BOS controls. The IC3 associates bulletins and authorities with trains based on the content of the enforceable instruction messages received from Railroad Systems and calculates the IC3 Composite CRCs for each train. The IC3 uses the stored enforceable instruction data and associations to calculate the Individual MD CRCs (for each enforceable instruction) and the IC3 Composite CRC (for each train and subdivision/district). IC3 provides the Individual MD CRCs and IC3 Composite CRC to G BOS through a messaging interface.

Existing train control segments may be modified to implement the IC3 Individual and Composite CRC designs. For example, Individual and Composite CRC Calculator (IC3) applications may be included in a BOS instance, e.g., one application for each G BOS process. A message replicator function may be included, one between Railroad Systems and BOS and one between on-board and BOS. The message replicator function(s) replicates all messages between respective communication parties via Class D link (no filtering) as discussed above with respect to FIG. 5B. A Class D link may be included for the interface between IC3 and the G BOS.

For Movement Authority in an individual CRC implementation, an IC3 Authority CRC field may be included in the Movement Authority Dataset (01051) message. The G BOS populates this field with the IC3 Authority CRC. The G BOS has no knowledge of how this CRC is calculated, as it acts merely as a pass-though. An enumeration may be included in the "Acknowledgement Indication" field in the Confirmation of Movement Authority (02052) message. This value indicates IC3 Authority CRC mismatch: "NAK-Failed IC3 authority CRC check". An error code, event, and configurable BOS action may be included to trigger on the new NAK value in the 02052 message. A field may be included in the Movement Authority Void (01053) message to transmit the IC3 Authority Void CRC over the authority void to the on board. Again, the G BOS has no knowledge of how this CRC is calculated. An enumeration may be included in the "Acknowledgement Indication" field in the Confirmation of Movement Authority Void (02053) message. This value indicates IC3 Authority Void CRC mismatch: "NAK-Failed IC3 authority void CRC check". An error code, event, and configurable BOS action may be included to trigger on the new NAK value in the 02053 message.

For Bulletins in an individual CRC implementation, an IC3 Bulletin CRC field may be included in the Bulletin Dataset (01041) message. The G BOS populates this field with the IC3 Bulletin CRC. As discussed, the G BOS has no knowledge of how this CRC is calculated. An enumeration may be included in the "Acknowledgement Indication" field in the Confirmation of Bulletin Dataset (02042) message to indicate IC3 Bulletin CRC mismatch: "NAK-Failed IC3 bulletin CRC check". An error code and event in the BOS may be included to trigger an existing CAD-BOS configurable action for the subdivision/district(s) identified in the 02042 message. A BOS CFG may be included to let customers pick a BOS action for the subdivision/district(s) when either the Individual MD CRC or IC3 Composite CRC fails validation. A field may be included in the Bulletin Cancellation (01043) message to transmit the IC3 Bulletin Void CRC over the voided bulletin item to the on-board. As the G BOS has no knowledge of how this CRC is calculated, an enumeration may be included in the "Acknowledgement Indication" field in the Confirmation of Bulletin Cancellation (02043) message to indicate IC3 Bulletin Void CRC mismatch: "NAK-Failed IC3 bulletin void CRC check". An error code and event may be included in the BOS to trigger an existing CAD-BOS configurable action for the subdivision/district(s) identified in the 02043 message.

For a Composite CRC Implementation, a Poll Response (02021) message may be included to respond to a G BOS Office Segment Poll (01021) message when a second IC3 Composite CRC mismatches. An IC3 Composite CRC field may be included in the Office Segment Poll (01021) message for the G BOS to populate directly with the IC3 Composite CRC that it requests from IC3 before every poll message. An error code and event may be included in the BOS to trigger an existing IC3-BOS configurable action (UB1 or UB2) for the subdivision(s) identified in the Poll Response (02021) message when the IC3 Composite CRC does not match as determined by the on-board.

The IC3 may be programmed or configured to support a single G BOS process. The IC3 may be subject to the same performance and availability guidelines as required of a G BOS process (for receiving/processing messages). The IC3 may be configured with definitions of its class D connections to replicators and each G BOS. The IC3 uses locomotive OPKs for authenticating messages between G BOS and on-board.

The IC3 may be programmed or configured to attempt to correct a connection problem with BOS or the replicator by retrying the connection per the class D configuration settings. The IC3 does not directly correct or report failures. When the IC3 detects a validation error in a message the IC3 discards the message and the IC3 Composite CRC is calculated without the data received in the message. This results in safe behavior by the on-board system.

In one preferred and non-limiting embodiment, the IC3 logs data in one or more CSV files. The IC3 logs the receipt of all messages with the following information: Message Source, Receipt Time, and Message Number. The IC3 logs additional information for messages that contain data that is stored including Message Data, Message CRC, and Message Validity. The IC3 logs the following information: Individual MD CRCs calculation results, IC3 Composite CRC calculation results, Train ID to Locomotive ID associations, and Enforceable instruction to Train ID/Locomotive ID associations.

The BOS may include an interface for IC3 messaging and behaviors for sending the Request Individual MD CRC message and receiving the Individual MD CRC message, including retries. The BOS may populate the Movement Authority Dataset (01051) message with the IC3 Authority CRC, include requirement(s) to act on a NAK in the Confirmation of Authority Dataset (02052) message with the new event (based on CFG), populate the Movement Authority Void (01053) message with the IC3 Authority Void CRC, include requirement(s) to respond to a NAK in the Confirmation of Movement Authority Void (02053) message with the new event (based on CFG), populate the Bulletin Dataset (01041) message with the IC3 Bulletin CRC, include requirement(s) to respond to a NAK in the Confirmation of Bulletin Dataset (02042) message with the new event (based on CFG), populate the Bulletin Cancellation (01043) message with the IC3 Bulletin Void CRC, and include requirement(s) to respond to a NAK in the Confirmation of Bulletin Cancellation (02043) message with the new event (based on CFG), include a new event to log and notify per railroad direction.

A BOS requesting an IC3 Composite CRC may include an interface for IC3 messaging and behaviors for sending the Request Composite CRC message and receiving the Request Composite CRC message, including retries, populate the Office Segment Poll (01021) message with the IC3 Composite CRC, include behaviors in response to the Poll Response (02021) NAK message based on message content and configuration settings, and include logging of IC3 messages to the existing BOS message logging functions.

In another preferred and non-limiting embodiment, the BOS connects via a class D connection to the IC3. If there is a connection problem, BOS retries the connection per the configured class D settings for the connection. Before the G BOS issues an enforceable instruction to on-board, the G BOS requests the associated IC3 Individual MD CRC from IC3. When the G BOS receives the IC3 Individual MD CRC, the G BOS sends the enforceable instruction message to the on-board system. If the G BOS does not receive the IC3 Individual MD CRC the G BOS does not send the enforceable instruction message to on-board system. Before the G BOS polls an on-board, the G BOS requests the IC3 Composite CRC for each subdivision/district for the associated train ID. When the G BOS receives the IC3 Composite CRC and meets all other existing polling conditions, the G BOS adds the IC3 Composite CRC to the Office Segment Poll (01021) message. If the G BOS does not receive the IC3 Composite CRC the G BOS does not send the Office Segment Poll (01021) message.

The G BOS receives the new Poll Response (02021) message. The message has a Status bit field indicating which fields in the message match the fields in the last sent Office Segment Poll (01021) message. When the G BOS is in Explicit control mode for a subdivision/district and the Status field in the Poll Response (02021) message for that subdivision/district indicates that the Dataset CRC matches and the IC3 Composite CRC does not match, the BOS takes the configured action (only UB1 or UB2 are allowed), associated with an event number. The G BOS ignores the Poll Response (02021) message when not in Explicit control mode.

A new numbered event and CFG may be added for the BOS to perform configurable behavior (UB1 or UB2) when the BOS receives a Poll Response (02021) message from the on-board system with the Status field indicating a matched Dataset CRC and mismatched IC3 Composite CRC. A new numbered event may be added to BOS when IC3 does not respond to a Request Individual MD CRC message with a valid Individual MD CRC message. A new numbered event may be added to BOS when IC3 does not respond correctly to a Request Composite CRC message. A new CFG may be added to configure the BOS to interface with the IC3.

In one preferred and non-limiting embodiment, the on-board system is updated to verify each of the IC3 generated CRCs and provide the appropriate response to the G BOS when a CRC mismatch is detected. The on-board system is updated to verify the IC3 Authority CRC when the on-board system receives a Movement Authority Dataset (01051)

message from the G BOS. The on-board system calculates the IC3 Authority CRC based upon the data within the Movement Authority Dataset (01051) message. The on-board system compares the on-board calculated IC3 Authority CRC to the IC3 Authority CRC received within the Movement Authority Dataset (01051) message. If the on-board system calculates an IC3 Authority CRC that matches the IC3 Authority CRC received in the message in addition to existing verification items, the on-board segment sends the Confirmation of Movement Authority (02052) message with a positive acknowledgement to the G BOS. If the on-board system calculates an IC3 Authority CRC that does not match the IC3 Authority CRC received in the message, the on-board system sets the associated subdivision/district to "non-synchronized" and sends the Confirmation of Movement Authority (02052) message with a negative acknowledgement to the G BOS indicating the mismatch. The Movement Authority Dataset (01051) and Confirmation of Movement Authority (02052) messages are updated.

In one preferred and non-limiting embodiment, the on-board system is updated to verify the IC3 Authority Void CRC when the on-board system receives a Movement Authority Void (01053) message from the G BOS. The on-board system calculates the IC3 Authority Void CRC based upon the data within the Movement Authority Void (01053) message. The on-board system compares the on-board calculated IC3 Authority Void CRC to the IC3 Authority Void CRC received within the Movement Authority Void (01053) message. If the on-board system calculated IC3 Authority Void CRC matches the IC3 Authority Void CRC in addition to existing verification items, the on-board system sends the Confirmation of Movement Authority Void (02053) message with a positive acknowledgement to the G BOS. If the on-board calculated IC3 Authority Void CRC does not match the IC3 Authority Void CRC received in the message, the on-board system sets the associated subdivision/district to "non-synchronized" and sends the Confirmation of Movement Authority Void (02053) message with a negative acknowledgement to the G BOS indicating the mismatch. The Movement Authority Void (01053) and Confirmation of Movement Authority Void (02053) messages are updated.

In one preferred and non-limiting embodiment, the on-board system is updated to verify the IC3 Bulletin CRC when the on-board system receives a Bulletin Dataset (01041) message from the G BOS. The on-board system calculates the IC3 Bulletin CRC based upon the data within the Bulletin Dataset (01041) message. The on-board system compares the on-board calculated IC3 Bulletin CRC to the IC3 Bulletin CRC received within the Bulletin Dataset (01041) message. If the on-board calculated IC3 Bulletin CRC matches the IC3 Bulletin CRC received in the message in addition to existing verification items, the on-board system sends the Confirmation of Bulletin Dataset (02042) message with a positive acknowledgement to the G BOS. If the on-board system calculates an IC3 Bulletin CRC that does not match the IC3 Bulletin CRC received in the message, the on-board system sets the associated subdivision/district to "non-synchronized" and sends the Confirmation of Bulletin Dataset (02042) message with a negative acknowledgement to G BOS indicating the mismatch. The Bulletin Dataset (01041) and Confirmation of Bulletin Dataset (02042) messages are updated.

In one preferred and non-limiting embodiment, the on-board system is updated to verify the IC3 Bulletin Void CRC when the on-board system receives a Bulletin Cancellation (01043) message from the G BOS. The on-board system calculates the IC3 Bulletin Void CRC based upon the data within the Bulletin Cancellation (01043) message. The on-board system compares the on-board calculated IC3 Bulletin Void CRC to the IC3 Bulletin Void CRC received within the Bulletin Cancellation (01043) message. If the on-board calculated IC3 Bulletin Void CRC matches the IC3 Bulletin Void CRC received in the message in addition to existing verification items, the on-board segment sends the Confirmation of Bulletin Cancellation (02043) message with a positive acknowledgement to the G BOS. If the on-board system calculates an IC3 Bulletin Void CRC that does not match the IC3 Bulletin Void CRC received in the message, the on-board system sets the associated subdivision/district to "non-synchronized" and sends the Confirmation of Bulletin Cancellation (02043) message with a negative acknowledgement to the G BOS indicating the mismatch. The Bulletin Cancellation (01043) and Confirmation of Bulletin Cancellation (02043) messages are updated.

In one preferred and non-limiting embodiment, the on-board system is updated to verify the IC3 Composite CRC and send the Poll Response (02021) message as part of the polling process. The on-board system calculates a matching IC3 Composite CRC in addition to meeting all existing conditions to be "synchronized" with the G BOS for a subdivision/district. The on-board system sends the Poll Response (02021) message upon receiving an Office Segment Poll (01021) message for which the on-board system detects a CRC mismatch. When the on-board system receives a valid Office Segment Poll (01021) message and all CRCs in the message match, no action is required. When the G BOS reports that it is in Non-Explicit control or Synchronize mode, the existing on-board behavior remains unchanged and the IC3 Composite CRC is not checked. The on-board system does not validate the IC3 Composite CRC while the G BOS is in Synchronize mode because the set of enforceable instructions stored by the G BOS and the IC3 may be changing throughout the synchronizing process. The on-board system does not validate the IC3 Composite CRC while the G BOS is in Non-Explicit control mode because the G BOS does not issue more permissive authorities in this mode and the IC3 does not include logic to determine permissiveness of an authority.

In one preferred and non-limiting embodiment, when the on-board system receives a valid Office Segment Poll (01021) message and the G BOS reports that it is in Explicit control mode the on-board system checks the IC3 Composite CRC in addition to the Dataset CRC for determining synchronization status. The on-board system verifies the Dataset CRC and the IC3 Composite CRC. The on-board system verifies the Dataset CRC and synchronizes datasets with the G BOS per current functionality. After the calculated Dataset CRC matches the received Dataset CRC, the on-board system calculates the IC3 Composite CRC for the associated subdivision/district. The on-board system calculates the IC3 Composite CRC using the IC3 Authority CRCs received in Movement Authority Dataset (01051) messages and IC3 Bulletin CRCs received in Bulletin Dataset (01041) messages. The on-board system compares the calculated IC3 Composite CRC to the IC3 Composite CRC received within the Office Segment Poll (01021) message. If the calculated IC3 Composite CRC does not match the received IC3 Composite CRC, the on-board system sends a Poll Registration (02020) message requesting another Poll message for the subdivision/district. When the on-board system receives a second Office Segment Poll message and the on-board calculated IC3 Authority CRC still does not match, the on-board system sets the subdivision to "non-synchronized"

and sends the Poll Response (02021) message with a negative acknowledgment to the G BOS indicating the mismatch. When the calculated IC3 Composite CRC matches the IC3 Composite CRC received in the Office Segment Poll (01021) message, the on-board system continues normal operation. If all existing conditions for synchronization are met in addition to the IC3 Composite CRC match, the on-board system sets the subdivision/district to "synchronized".

In one preferred and non-limiting embodiment, the Office-Locomotive ICD is modified to add the IC3 Authority CRC field to the Movement Authority Dataset (01051) message and update the enumeration in the Confirmation of Authority Dataset (02052) message to indicate an IC3 Authority CRC mismatch. The Office-Locomotive ICD is modified to add the IC3 Authority Void CRC field to the Movement Authority Void (01053) message and update the enumeration in the Confirmation of Movement Authority Void (02053) message to indicate IC3 Authority Void CRC mismatch. The Office-Locomotive ICD is modified to add the IC3 Bulletin CRC field to the Bulletin Dataset (01041) message and update the enumeration in the Confirmation of Bulletin Dataset (02042) message to indicate an IC3 Bulletin CRC mismatch. The Office-Locomotive ICD is modified to add the IC3 Bulletin Void CRC field to the Bulletin Cancellation (01043) message and update the enumeration in the Confirmation of Bulletin Cancellation (02043) message to indicate an IC3 Bulletin Void CRC mismatch.

The Office-Locomotive ICD is modified to add a new field in the Office Segment Poll (01021) message to a locomotive. The new field is "Composite CRC" within the "For each PTC Subdivision/District" loop. The Office-Locomotive ICD will contain the new Poll Response (02021) message sent from the on-board system to the G BOS upon receipt of the Office Segment Poll (01021) message.

An additional hazard related to enforcing enforceable instruction data exists. After the on-board system receives an enforceable instruction, the on-board system transforms the provided milepost limit data to the block and offset data associated with the track database. There are two associated and potential hazards. The on-board system may introduce an error during limit transformation and correctly transformed limits may not be at the correct physical location. Preferred and non-limiting embodiments of the inventive system and method provide a mitigation of this hazard that addresses transformation hazards that are outside of the G BOS hazards described above. This breaks down into three error sources that result in incorrect on-board transformation results: software errors, hardware errors, and track database errors. Software errors, including errors in requirements, implementation, and compilation may exist resulting in transformed enforceable instruction data pointing to incorrect location(s) within the track database. This is mitigated by following a structured design and verification process that is compliant with 49 C.F.R. § 236, Appendix C. Triplex design mitigates the second error source where random hardware faults result in an error in the enforceable instruction data transformation. The Triplex design, in conjunction with the cross channel comparison, detects any issues related to faulty hardware that could alter the results of the enforceable instruction data transformation. The final error source is that enforceable instruction data milepost limits are not at the correct physical location. One mitigation approach requires each track database be validated for correctness prior to being used for PTC operation. The required validation ensures the locations of features in the track data match their physical location. Note that there has not been any validation between Railroad System dispatchable points and the track database and that each railroad is responsible for their own track validation. Each track database is protected by a CRC to ensure integrity while being transferred between different segments of the train control system. Accordingly, transformation hazards are mitigated by a design and verification process, triplex processor design, and track validation according to preferred and non-limiting embodiments.

FIG. 5C is a table showing PTC systems behaviors according to one preferred and non-limiting embodiment. FIG. 5C provides on-board and G BOS response to messages sent to the on-board system in example scenarios in a PTC system. The G BOS mode, Dataset CRC, IC3 Composite CRC, IC3 Authority or Void CRC, and IC3 Bulletin or Void CRC conditions for each scenario are also provided.

Figure 6A:
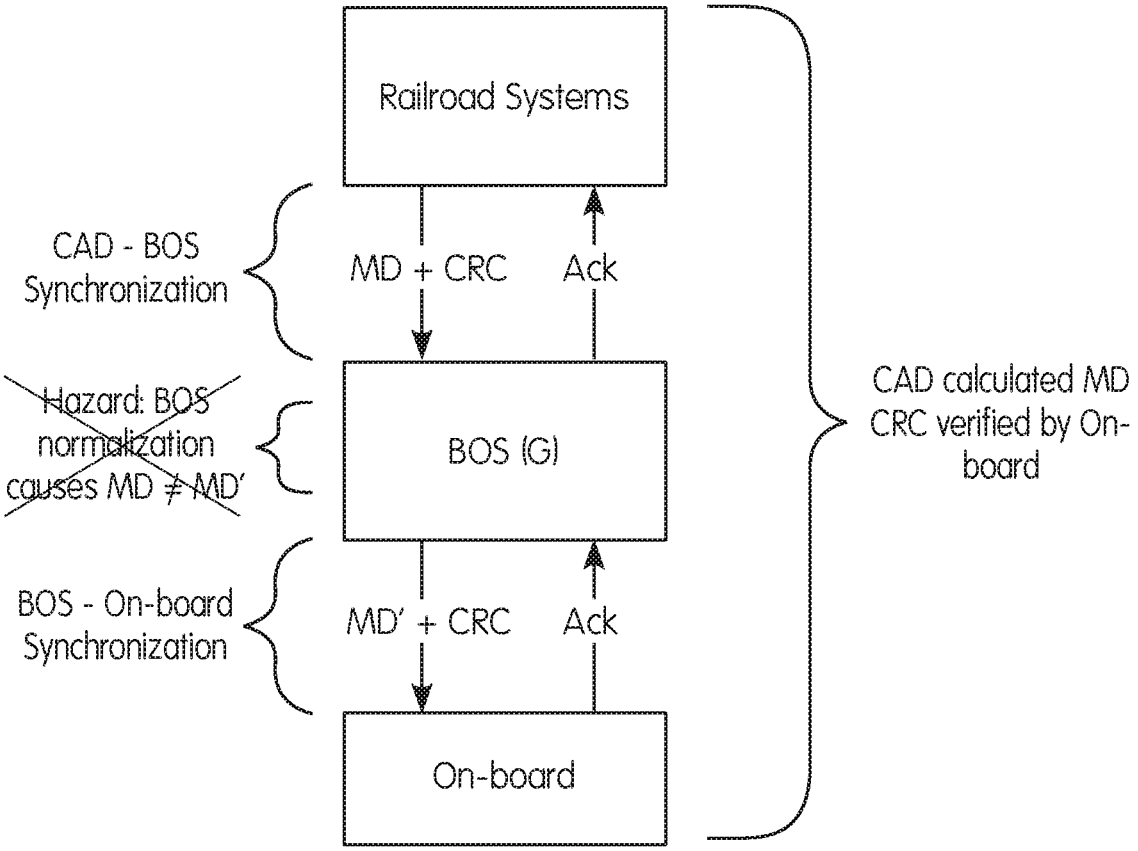
FIG. 6A is a flow chart illustrating a method and system for CRC hazard mitigation according to another preferred and non limiting embodiment.
Figure 6B:
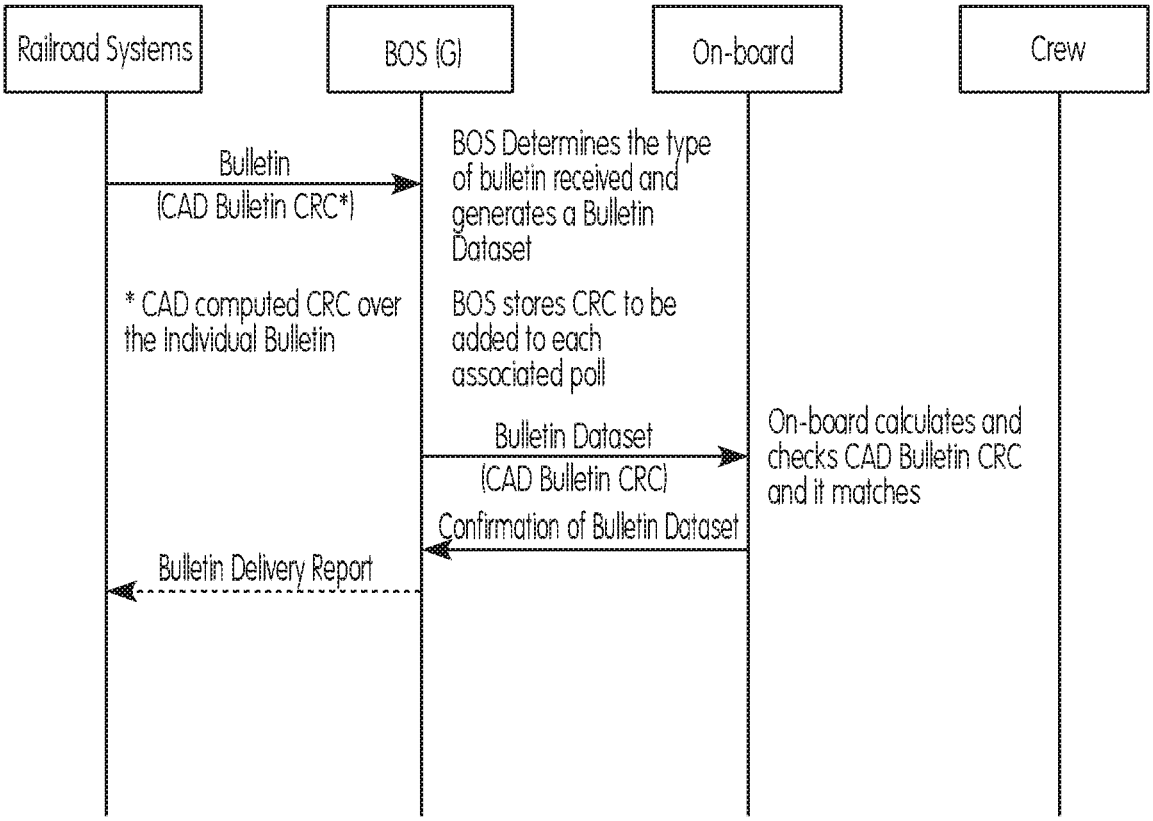
FIG. 6B is a signal/data flow chart illustrating a successful delivery of a bulletin according to a preferred and non-limiting embodiment.
Figure 6C:
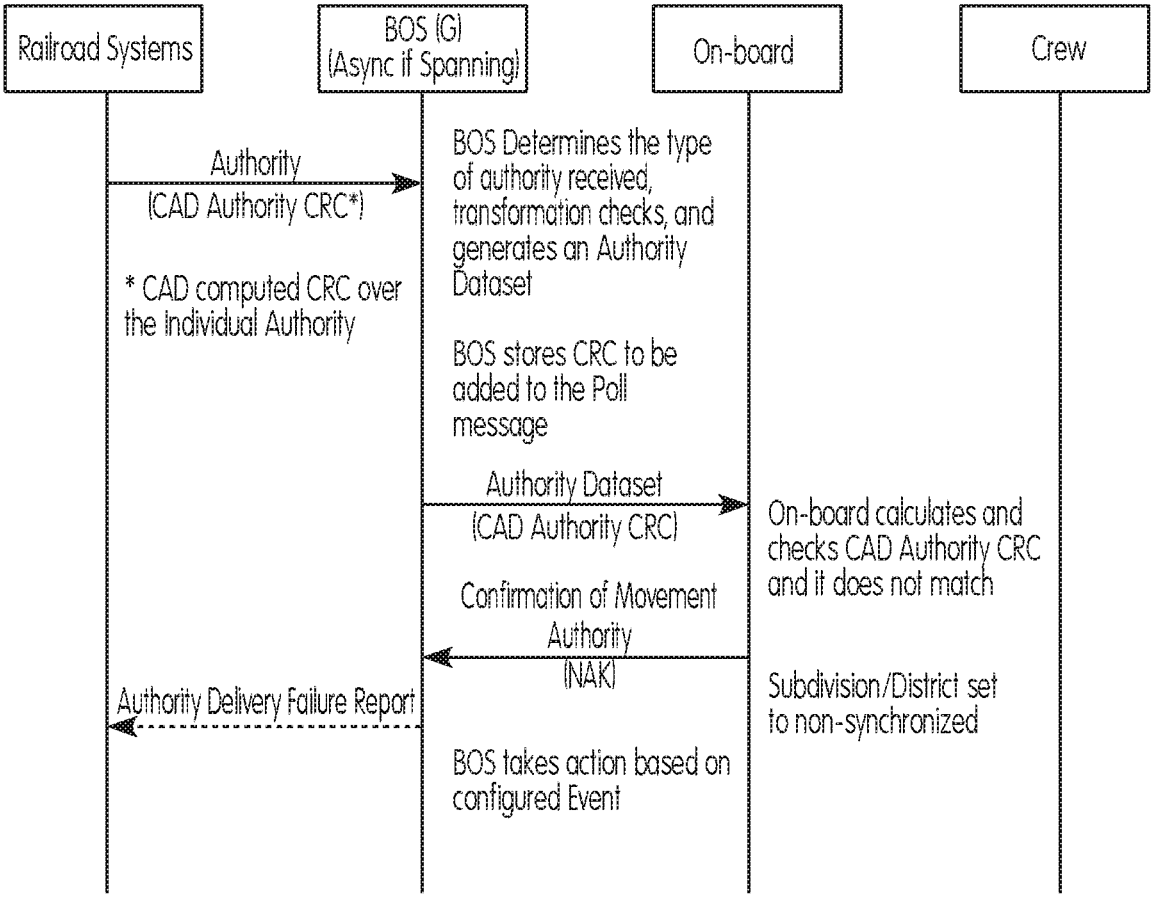
FIG. 6C is a signal/data flow chart illustrating an authority CRC mismatch according to a preferred and non-limiting embodiment.

FIG. 6A is a flow chart illustrating a method and system for CRC hazard mitigation according to another preferred and non limiting embodiment. FIG. 6B is a signal/data flow chart illustrating a successful delivery of a bulletin according to a preferred and non-limiting embodiment. FIG. 6C is a signal/data flow chart illustrating an authority CRC mismatch according to a preferred and non-limiting embodiment. A CAD CRC method and system according to a preferred and non-limiting embodiment is directed to normalization of enforceable instruction data, which provides an end-to-end (i.e. between the CAD and the PTC component on-board) verification of safety critical MD data. The CAD system provides enforceable instruction CRCs calculated over defined sets of safety critical enforceable instruction data. For example, four new CRCs are calculated and provided to the PTC system from the CAD, including: an authority data CRC (CAD Authority CRC), a bulletin data CRC (CAD Bulletin CRC), an authority void data CRC (CAD Authority Void CRC), and a bulletin void data CRC (CAD Bulletin Void CRC), collectively referred to as "MD CRC(s)". The CAD provides a MD CRC upon issuance of each enforceable instruction or void. The BOS passes the unaltered MD CRC to the on-board system within the enforceable instruction messages, and the on-board system verifies the enforceable instruction using the CAD-calculated MD CRC. The on-board system compares the CAD-calculated MD CRC to the equivalent on-board-calculated MD CRC (described above) when the associated enforceable instruction is received from the BOS. When the on-board-calculated MD CRC does not match the CAD-calculated MD CRC, the on-board system sends a message to the BOS and becomes "non-synchronized" for the subdivision associated with the mismatched MD CRC (FIG. 6C). When the BOS receives the message from the on-board system, it takes a configured action.

Figure 7:
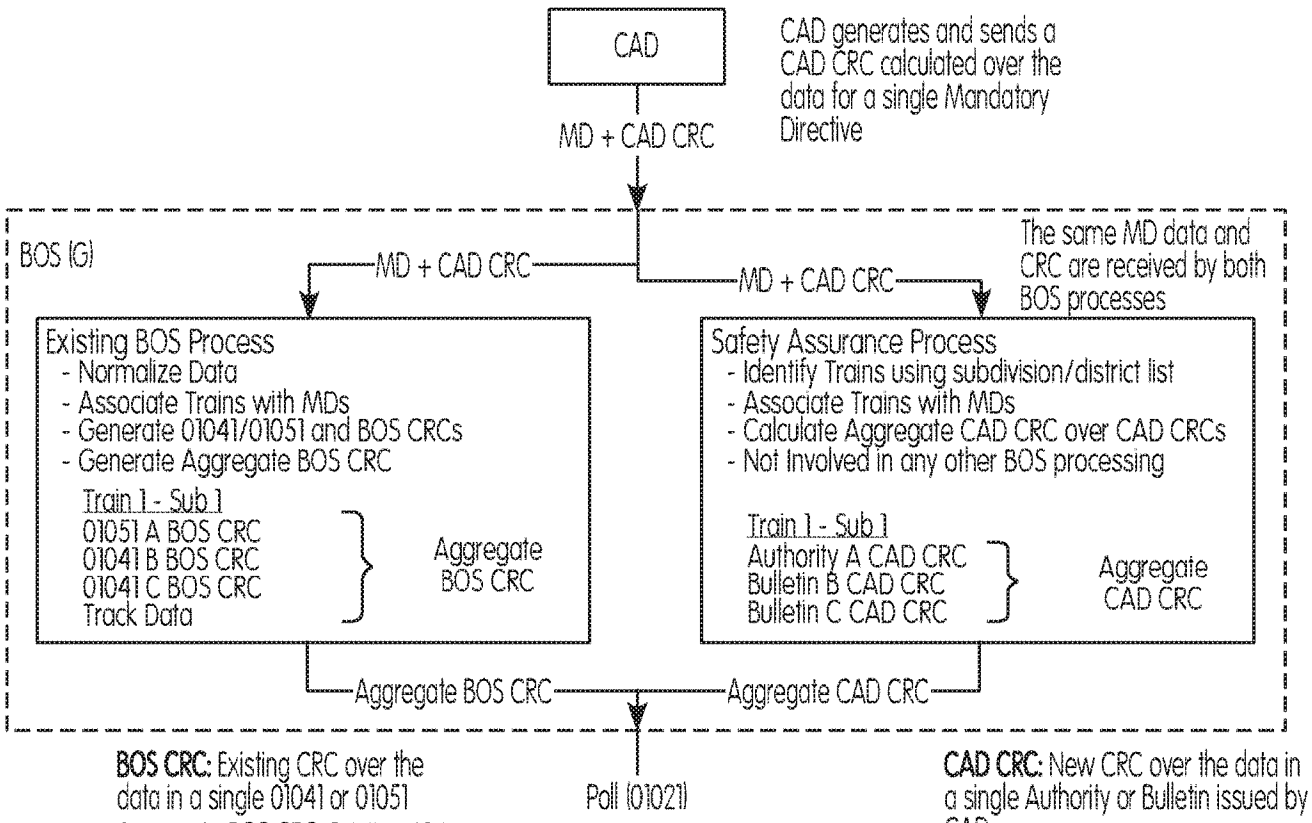
FIG. 7 is a flow chart illustrating a method and system for transmitting enforceable instructions in positive train control (PTC) systems according to another preferred and non-limiting embodiment.
Figure 8A:
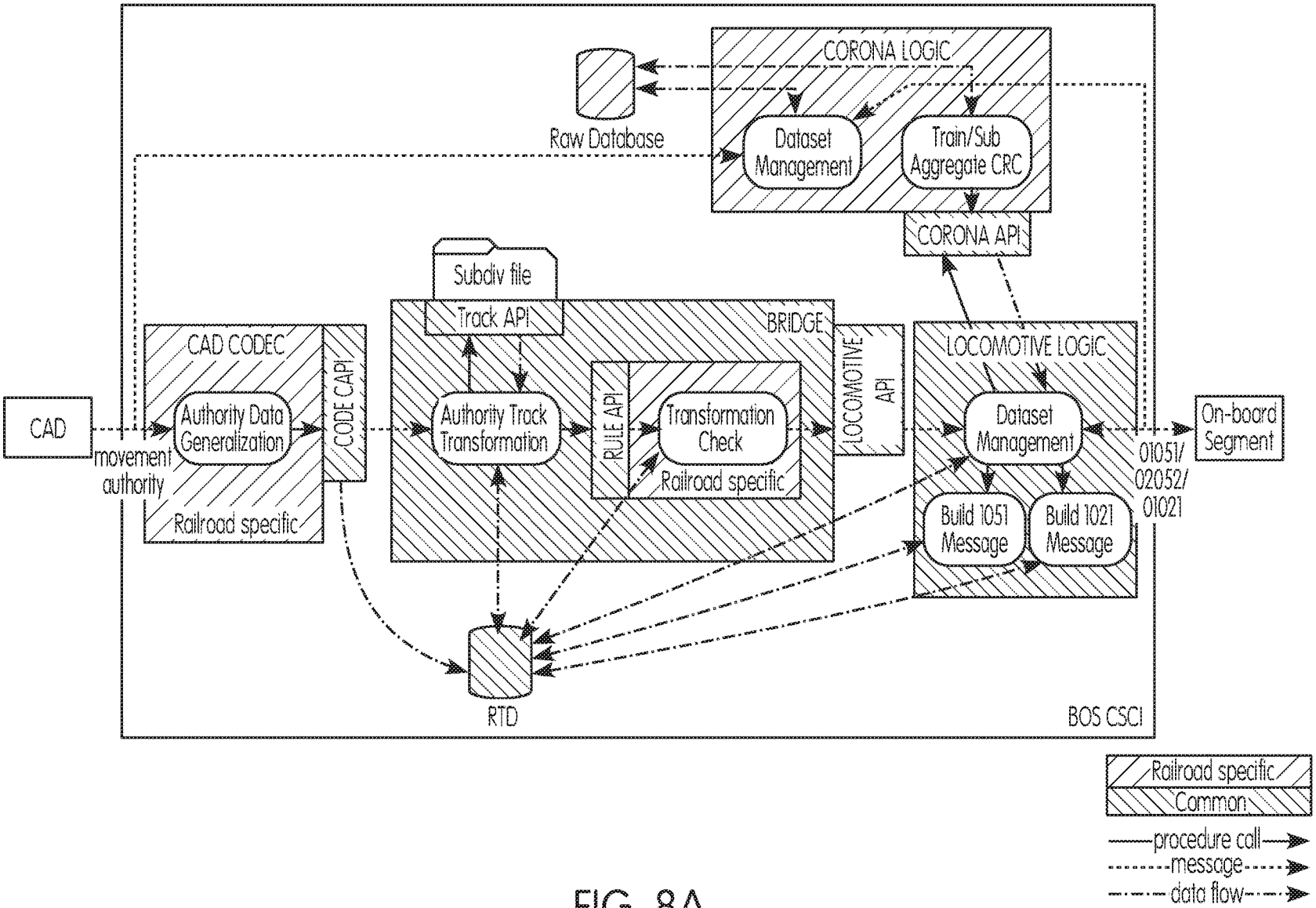
FIG. 8A is a block diagram of a system for transmitting enforceable instructions in positive train control (PTC) systems according to another preferred and non-limiting embodiment.
Figure 8B:
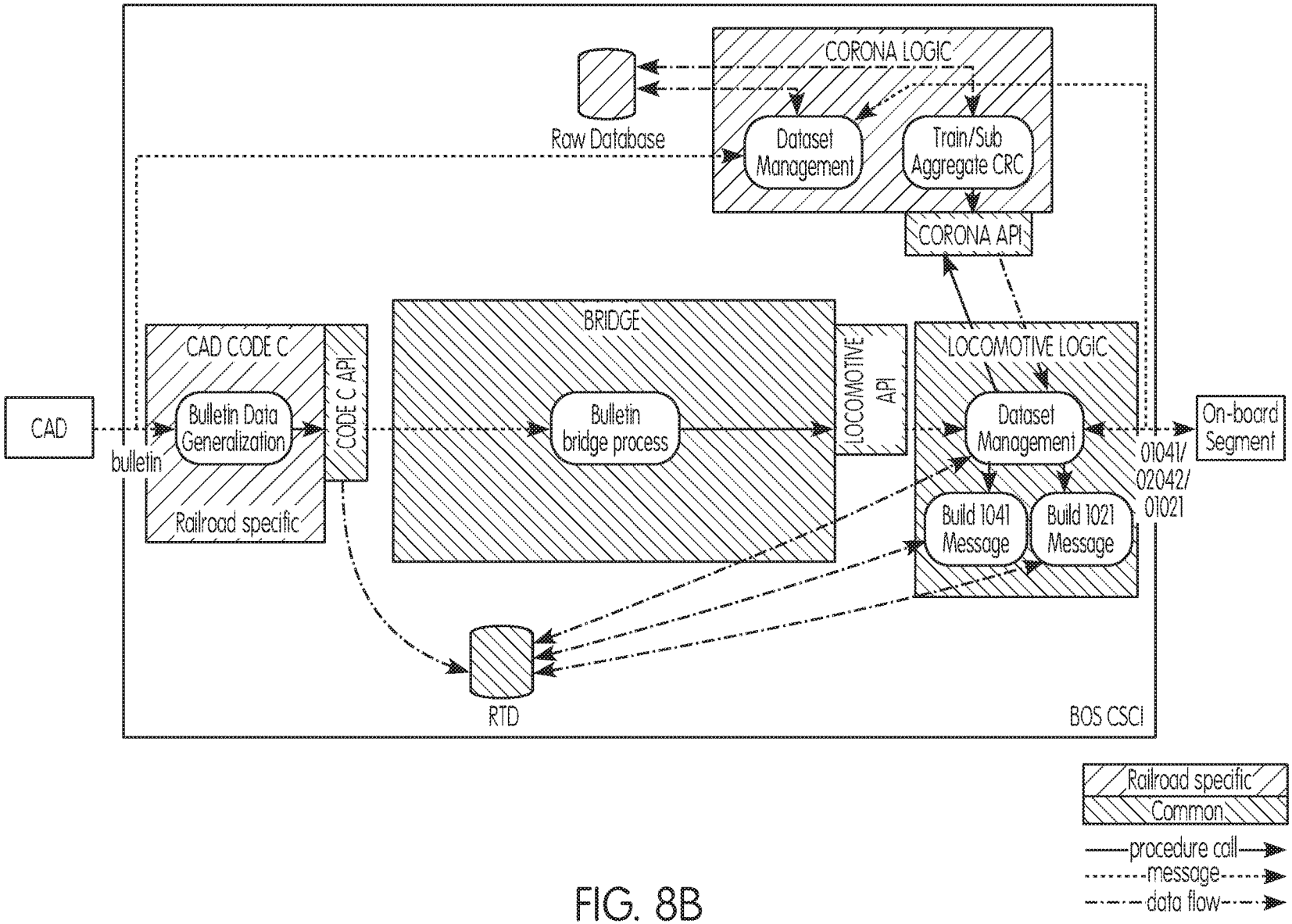
FIG. 8B is a block diagram of a system for transmitting enforceable instructions in positive train control (PTC) systems according to still another preferred and non-limiting embodiment.

FIG. 7 is a flow chart illustrating a method and system for transmitting enforceable instructions in positive train control (PTC) systems according to another preferred and non-limiting embodiment. A field is added to CAD authority messages to transmit the CAD Authority CRC over the authority from the CAD to the on-board system. The BOS has no knowledge of how this CRC is calculated. A CAD Authority CRC field is added to the Movement Authority Dataset (01051) message for the BOS to populate directly with the CAD Authority CRC. An enumeration to the "Acknowledgement Indication" field is added in the Confirmation of Movement Authority (02052) message to indicate CAD Authority CRC mismatch: "NAK-Failed CAD authority CRC check". An error code and event are added in the BOS to trigger a CAD-BOS configurable action for the subdivision(s) identified in the 02052 message. A field is added to CAD bulletin message(s) to transmit the CAD Bulletin CRC over the bulletin from the CAD to the on-board system. The BOS has no knowledge of how this CRC is calculated. A CAD Bulletin CRC field is added to the Bulletin Dataset (01041) message. An enumeration is added to the "Acknowledgement Indication" field in the Confirmation of Bulletin Dataset (02042) message to indicate CAD Bulletin CRC mismatch: "NAK-Failed CAD bulletin CRC check". An error code and event are added in the BOS to trigger CAD-BOS sync or stop for the subdivision(s) identified in the 02042 message. A BOS CFG is added to enable customers to pick a BOS action for the subdivision/district(s) when either of the above CRCs fails. A field is added to CAD authority void messages to transmit the CAD Authority Void CRC over the authority void from CAD to the on-board. A CAD Authority Void CRC field is added to the Movement Authority Void (01053) message for the BOS to populate directly with the CAD Authority CRC. A field is added to CAD bulletin void messages to transmit the CAD Bulletin Void CRC over the voided bulletin item from CAD to the on-board. A CAD Bulletin Void CRC field is added to the Bulletin Cancellation (01043) message. Critical Alert messages are included in the CAD Bulletin CRC, implying that the Critical Alert system is capable of the same CRC generation that CAD is capable of.

The IC3 or the CAD generates four CRCs: the CAD Authority CRC, CAD Authority Void CRC, CAD Bulletin CRC, and CAD Bulletin Void CRC. Each of the IC3 or CAD generated CRCs must be calculated over a set of data that can be determined by both the on-board system and the CAD. The IC3 or CAD Authority CRC is calculated over the following fields: Locomotive ID, Authority Type, PTC Authority Reference Number, Void Authority Number for reach authority void, Authority Segment Direction for each authority segment, Authority Segment Track for each authority segment, Authority Segment From Limit for each authority segment, Authority Segment Too Limit for each authority segment, Restriction Type for each authority restriction, Restriction Speed Limit for each authority restriction, Restriction Segment Track for each authority restriction, Restriction Segment From Limit for each authority restriction, Restriction Segment To Limit for each authority restriction, Conditional Track for each conditional item, Conditional Limit for each conditional item, Site Name, and Site Device ID.

In one preferred and non-limiting embodiment, the IC3 or CAD authority Void CRC is calculated over the PTC Authority Reference Number field. The IC3 or CAD Bulletin CRC is calculated over the following fields: PTC Bulletin Reference Number, Bulletin Segment Track for each bulletin segment, Bulletin Segment From Limit for each bulletin segment, Bulletin Segment To Limit for each bulletin segment, Speed Restriction Type for each bulletin segment, Speed Restriction Applicability for each speed restriction, Speed, Restricted Speed for each speed restriction, Effective Date/Time, Expiration Date/Time, and Department of Transportation (DOT) ID.

In one preferred and non-limiting embodiment, the IC3 or CAD Bulletin Void CRC is calculated over the PTC Bulletin Reference Number field. Each customer CAD system calculates a CAD Authority CRC according to the proposed field definitions and order described herein. A new field to accommodate the CAD Authority CRC is added to each railroad's authority message. Each customer CAD system calculates a CAD Authority Void CRC according to the proposed field definitions and order described herein. A new field to accommodate the CAD Authority Void CRC is added to each railroad's authority void message. Each customer CAD system calculates a CAD Bulletin CRC according to the proposed field definitions and order described herein. A new field to accommodate the CAD Bulletin CRC is added to each railroad's bulletin message(s). Each customer CAD system calculates a CAD Bulletin Void CRC according to the proposed field definitions described herein. A new field to accommodate the CAD Bulletin Void CRC is added to each railroad's bulletin void/cancel/release message. The CAD system performs the same message field transformation that the on-board system performs so that the CRCs match. Some field enumerations may need to change or transformation will take place to more closely match the on-board messaging.

The BOS populates the Movement Authority Dataset (01051) message with the new CAD Authority CRC, adds requirement(s) to respond to a NAK in the Confirmation of Authority Dataset (02052) message with the new event (based on CFG), populates the Movement Authority Void (01053) message with the new CAD Authority Void CRC, populates the Bulletin Dataset (01041) message with the new CAD Bulletin CRC, add requirement(s) to respond to a NAK in the Confirmation of Bulletin Dataset (02042) message with the new event (based on CFG), populates the Bulletin Cancellation (01043) message with the new CAD Bulletin Void CRC, add a new event to log and notify per railroad direction, and adds a new CFG to control BOS action on receiving a NAK from a locomotive.

In one preferred and non-limiting embodiment, the on-board system is updated to verify each of the CAD generated MD CRCs. The on-board system is updated to verify the CAD Authority CRC when the on-board system receives a Movement Authority Dataset (01051) message from the BOS, and the CAD Authority Void CRC when the on-board system receives a Movement Authority Void (01053) message from the BOS. The on-board system calculates the CAD Authority CRC or CAD Authority Void CRC based upon the data within the Movement Authority Dataset (01051) or Movement Authority Void (01053) message. The on-board system compares the on-board calculated MD CRC to the CAD MD CRC received within the Movement Authority Dataset (01051) or Movement Authority Void (01053) message. If the on-board calculated MD CRC matches the CAD MD CRC in addition to existing verification items, the on-board system sends the confirmation message (02052/02053) with a positive acknowledgement to BOS. If the on-board calculated MD CRC does not match the CAD MD CRC, the on-board system sets the associated subdivision/district to "non-synchronized" and sends the confirmation (02052/02053) message with a negative acknowledgement to BOS. The on-board system is updated to verify the CAD Bulletin CRC when the on-board system receives a Bulletin Dataset (01041) message from the BOS, and the CAD Bulletin Void CRC when it receives a Bulletin Cancellation (01043) message from BOS. The on-board system calculates the CAD Bulletin CRC or CAD Bulletin Void CRC based upon the data within the Bulletin Dataset (01041) or Bulletin Cancellation (01043) message. The on-board system compares the on-board calculated MD CRC to the CAD MD CRC received within the Bulletin Dataset (01041) or Bulletin Cancellation (01043) message. If the On-board calculated MD CRC matches the CAD MD CRC in addition to existing verification items, the on-board segment sends the confirmation message (02042/02043) with a positive acknowledgement to BOS. If the on-board calculated MD CRC does not match the CAD MD CRC, the on-board segment sets the associated subdivision/district to "non-synchronized" and the confirmation message (02042/02043) with a negative acknowledgement to BOS.

In one preferred and non-limiting embodiment, an Office-Locomotive ICD may be modified to add a new field in the Movement Authority Dataset (01051) message to a locomotive for the CAD Authority CRC, and a new enumeration in the Confirmation of Authority Dataset (02052) message. The Office-Locomotive ICD may be modified to add a new field in the Movement Authority Void (01053) message to a locomotive for the CAD Authority Void CRC, and a new enumeration in the Confirmation of Authority Dataset (02052) message. The Office-Locomotive ICD may be modified to add a new field in the Bulletin Dataset (01041) message to a locomotive for the CAD Bulletin CRC, and a new enumeration in the Confirmation of Bulletin Dataset (02042) message. The Office-Locomotive ICD may be modified to add a new field in the Bulletin Cancellation (01043) message to a locomotive for the CAD Bulletin Void CRC, and a new enumeration in the Confirmation of Bulletin Dataset (02042) message.

The CAD CRC based end-to-end MD CRC verification mitigates or potentially addresses one or more of the hazards discussed above. The on-board system verifies the MD CRC for an enforceable instruction, ensuring safety critical data is not being altered as sent from CAD. When safety critical data corruption is detected, the on-board system behaves safely by setting the associated subdivision/district to "non-synchronized" and performing associated existing behaviors. The on-board system clearly indicates that the on-board system is not providing PTC protection while the train is operating in a "non-synchronized" subdivision.

As discussed, a Safety Assurance Concept utilized with a CAD CRC based method and system is the Diversity and Self Checking process implemented as a Self-Checking Code. Incorporation of the CAD Authority CRC or CAD Bulletin CRC data into the BOS created enforceable instruction messages enables the on-board processors to independently validate that the safety critical data is received as sent from the CAD.

As discussed, various hazards related to enforcing MD data may exist. After the on-board system has validated the CAD MD CRC for a received MD, the on-board system transforms the provided milepost data to the block and offset data associated with the track database. The train control system should ensure that the result of the transformation is equivalent to the original milepost data and ensure that the train control system enforces the data physical location specified by CAD. Accordingly, and as discussed, three issues that result in incorrect transformation results may include: software errors, hardware errors, and track database errors. Software errors, including requirements, implementation, and compilation may result in transformed MD data pointing to incorrect location(s) within the track database. This hazard may be mitigated by following a structured design and verification process that is compliant with 49 C.F.R. § 236. Triplex design mitigates the second hazard where random hardware faults result in an error in the MD data transformation. The Triplex design, in conjunction with the cross channel comparison, detects any issues related to faulty hardware that could alter the results of the MD data transformation. The final hazard is that MD data milepost limits are not at the correct physical location. The train control system mitigation requires any provided production version, CRC-protected track database to be validated for correctness prior to being used for PTC operation. Once a track database has been validated, version confirmation during initialization, CRC verification and cross channel comparison of databases in use ensures that the data can be safely used to transform milepost data to block and offset.

With respect to "synchronization" events, certain scenarios should be considered. For a first scenario, an enforceable instruction is on-board that is not included in the Office Segment Poll (01021) due to polling timing. The G BOS issues a poll at the same time as the G BOS receives a new enforceable instruction from Railroad Systems. The G BOS issues the new enforceable instruction that was not included in the poll. Due to messaging system delay and the order of messages not being guaranteed, the on-board system receives the new enforceable instruction first and adds the enforceable instruction to its calculated Dataset CRC. The on-board system receives the Office Segment Poll (01021) second and detects a mismatched Dataset CRC because the new enforceable instruction was not included in the message. The on-board system sets the associated subdivision/district to "non-synchronized". This scenario may occur if Railroad Systems issues an enforceable instruction at about the same time as the G BOS needs to send a poll. The result is indeterminate as to whether the enforceable instruction is included in the poll and the order the messages reached the on-board. It should be noted that current on-board behavior sends the Request Dataset List (02022) message to the G BOS. The Dataset List (01022) message sent by the G BOS shows the on-board system does have the correct enforceable instructions. The on-board system waits until the next poll timeout for the next opportunity to become synchronized.

For a second scenario, the enforceable instructions on-board are not the same as included in the Office Segment Poll (01021) due to crew action. The G BOS issues a poll. The crew responds to an authority prompt for an authority that requires crew action (acknowledge/accept/reject). The on-board system receives an Office Segment Poll (01021) message that does not include the result of the crew action and detects a mismatched Dataset CRC. The on-board system sets the associated subdivision/district to "non-synchronized". This occurs when the crew action happens at about the same time as the G BOS sends a poll. The result is that the on-board becomes "non-synchronized" for the subdivision/district until the next Office Segment Poll (01021) message is received. The on-board system waits until the next poll timeout for the next opportunity to become synchronized. In both the first and the second scenario, the time which the on-board system is "non-synchronized" is the duration of the poll. In both scenarios, the on-board system becomes "synchronized" after the next poll is received providing that all other conditions are met for it to be "synchronized". It should be noted that this is most important for subdivisions that are near to the locomotive which can cause the on-board system to become Disengaged. A mismatch of the IC3 Composite CRC is more costly to the system, in terms of operational availability, than a Dataset CRC mismatch. This is because the result of the IC3 Composite CRC mismatch causes a CAD-G BOS sync which prevents the on-board system from becoming "synchronized" with G BOS for the poll duration plus CAD-G BOS sync duration (worst case).

For a third scenario, the on-board system determines that the Dataset CRC matches and the IC3 Composite CRC does not match due to poll timing. The G BOS determines that the G BOS needs to issue a poll due to a timeout. The G BOS requests the IC3 Composite CRC from the IC3. The G BOS and the IC3 each receive a new enforceable instruction. The IC3 sends the IC3 Composite CRC to the G BOS. The G BOS issues the poll to the on-board system. The on-board system receives the poll. The on-board system determines the Dataset CRC matches and the IC3 Composite CRC does not. The on-board system sets the associated subdivision/district to "non-synchronized" and responds with a Poll Response (02021) message indicating an IC3 Composite CRC mismatch. The G BOS resynchronizes with CAD. In this scenario, it is indeterminate whether the Dataset CRC and the IC3 Composite CRC represent the same set of enforceable instructions due to unfortunate timing of events. The on-board system "detects" that G BOS has not associated the correct set of enforceable instructions when it determines that the IC3 Composite CRC does not match. The G BOS is unnecessarily forced to resynchronize with Railroad Systems to recover.

Figure 9:
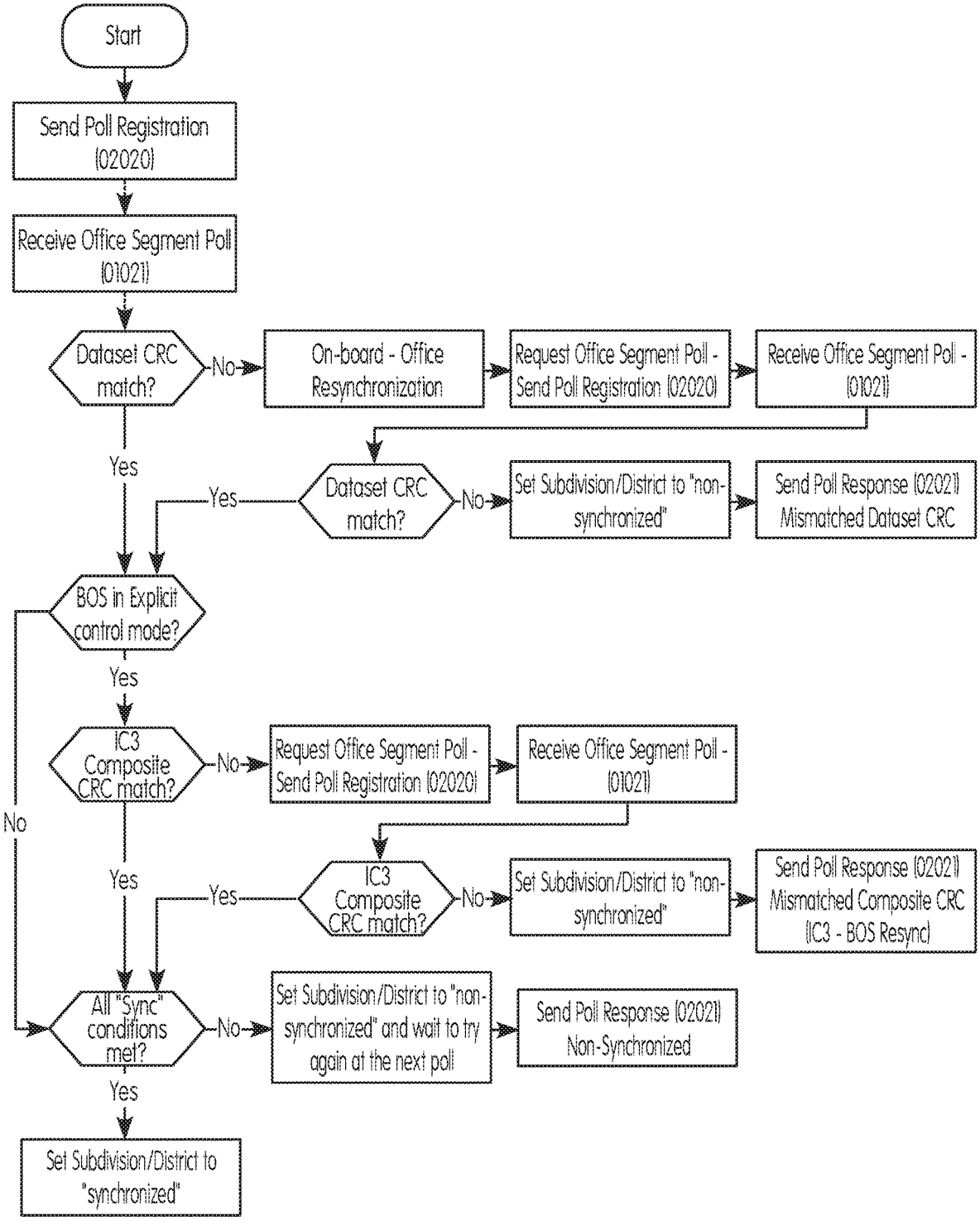
FIG. 9 is a flow chart of an updated polling process from an on-board perspective according to a preferred and non-limiting embodiment.

Each of the above scenarios centralize around a general theme: unfortunate timing resulting in an inadvertent operational outage. An effective way to prevent operational outages due to timing issues is for the system to become more tolerant of timing issues. The current polling process allows the on-board system continue to provide PTC functions and protection for a configured period of time while the on-board system has no communication with the office. FIG. 9 is a flow chart of an updated polling process from an on-board perspective according to a preferred and non-limiting embodiment. The train control system, e.g., the I-ETMS, may be updated to allow a tolerance for "non-synchronized" conditions that is within the polling tolerance. Accordingly, the on-board system may request an updated Office Segment Poll (01021) message from G BOS when either the Dataset CRC or IC3 Composite CRC do not match what is calculated.

Figure 10:
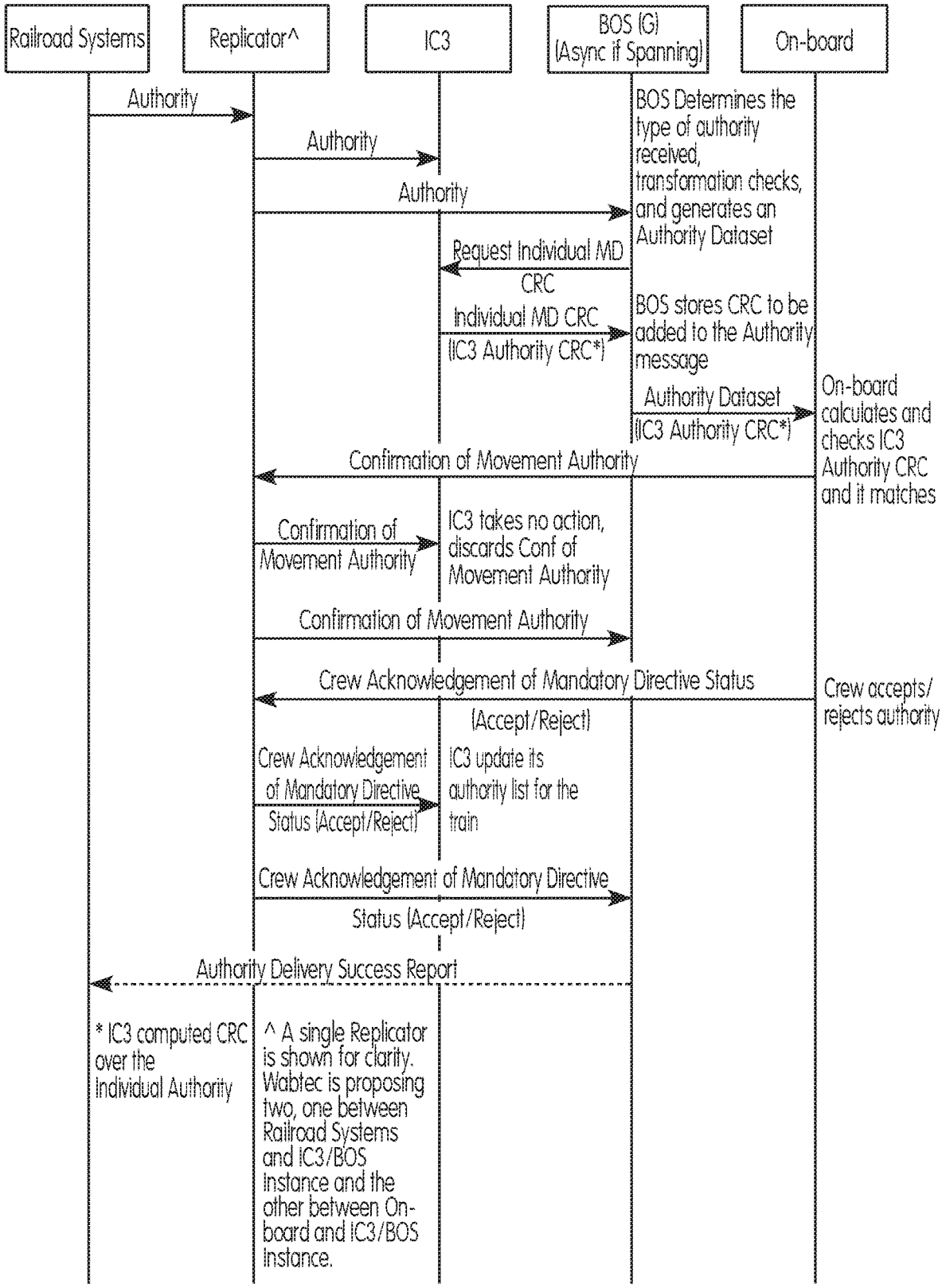
FIG. 10 is a flow diagram showing behavior of various segments when the on-board system detects a mismatch for an IC3 Authority CRC.
Figure 11:
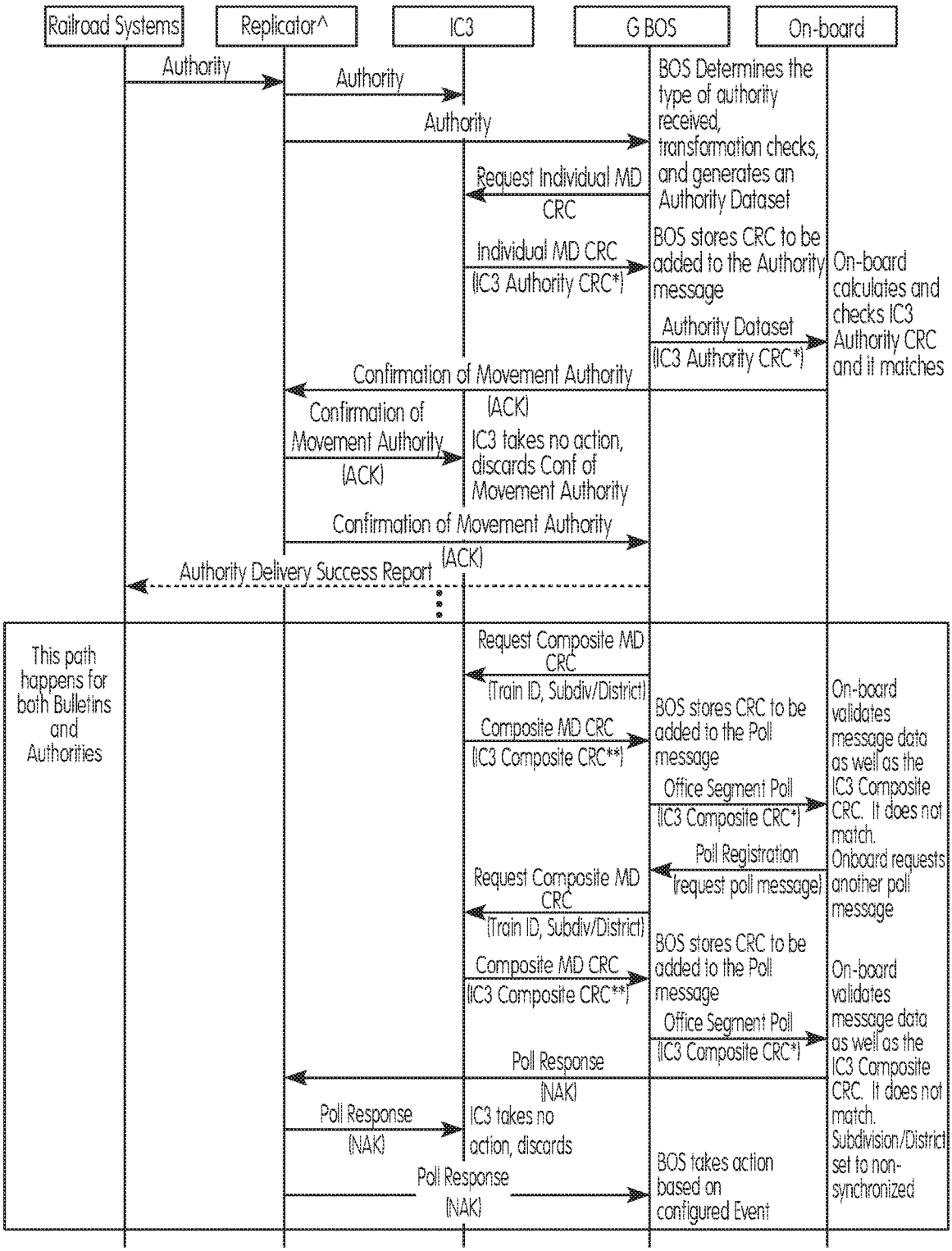
FIG. 11 is a flow diagram showing behavior of various segments when the on-board segment detects a mismatch for an IC3 Composite CRC.

FIG. 10 is a flow diagram showing behavior of various segments according to one preferred and non-limiting embodiment when the on-board system detects a mismatch for an IC3 Authority CRC. FIG. 11 is a flow diagram showing behavior of various segments according to one preferred and non-limiting embodiment when the on-board segment detects a mismatch for an IC3 Composite CRC. The on-board system is updated to request another Office Segment Poll (01021) message after a synchronization attempt with the office. When the on-board receives an unsolicited Office Segment Poll (01021) message that results in a Dataset CRC mismatch, the on-board system attempts to resynchronize datasets with the office. This behavior is left unchanged. After the on-board has determined that the set of enforceable instruction datasets on-board matches the set received in the Dataset List (01022) message, if the Dataset CRC still does not match, the on-board system requests an updated Office Segment Poll (01021) message. After the Office Segment Poll (01021) message is received, the on-board system compares the Dataset CRC again. If the Dataset CRC is a match, the on-board system continues to compare the IC3 Composite CRC. If the Dataset CRC is still a mismatch, the on-board system sets the subdivision/district to "non-synchronized" and sends the Poll Response (02021) message indicating a mismatched Dataset CRC. The on-board system is updated to request another Office Segment Poll (01021) message after an IC3 Composite CRC mismatch. If the requested Office Segment Poll (01021) message still is a mismatch with the calculated IC3 Composite CRC, the on-board system sets the associated subdivision/district to "non-synchronized" and sends the Poll Response (02021) message indicating a mismatched IC3 Composite CRC. Any timing issues that could cause the enforceable instructions represented in the Dataset CRC to not match the those represented in the IC3 Composite CRC should have been resolved by the time the requested poll is sent. The Poll Registration (02020) message is used to request a poll as well as register for polling. The message will be updated to include an enumeration to differentiate a poll registration from a poll request. G BOS will be updated to respond to a Poll Registration (02020) message requesting a poll with an immediate response with the Office Segment Poll (01021) message.

Certain G BOS modes and control thereof according to preferred and non-limiting embodiments are described in more detail below.

During a Non-Explicit control mode, the G BOS only sends more restrictive enforceable instructions to the on-board system for the associated subdivision/district. The IC3 does not have the same logic. This may cause the IC3 Composite CRC to be inconsistent with the Dataset CRC in the Office Segment Poll (01021) message during Non-Explicit control G BOS mode.

Because the G BOS determines whether to send enforceable instructions to a train during the Non-Explicit control mode based on the restrictiveness of the enforceable instruction, the enforceable instruction may not be included in the Dataset CRC but is included in the IC3 Composite CRC in the Office Segment Poll (01021) message. Because the on-board system knows the G BOS operating mode of the subdivision/district, the on-board system ignores the IC3 Composite CRC while the G BOS is in the Non-Explicit control mode. Current BOS requirements allow the G BOS to be configured with a timeout for Non-Explicit control mode (CFG 65). When the timeout expires, the G BOS transitions to Synchronize or Stop mode depending on configuration (CFG 6). Because the IC3 Composite CRC validations should not be allowed to be bypassed for an indefinite time period, the G BOS is updated to remove the configurability of the Non-Explicit control mode timeout (CFG 65). The timeout is always in effect when a G BOS is in Non-Explicit control mode. The timeout may be configured (TBC 109) and railroads should understand the safety implications when configuring the timeout. The implications being that the value configured for the timeout represents how much time a railroad allows the G BOS associations between enforceable instructions and trains to remain unchecked.

The IC3 Composite CRC may be inconsistent with the Dataset CRC in the Office Segment Poll (01021) message during Synchronize G BOS mode. When the G BOS is in Synchronize mode for a subdivision/district, it inserts a zero in the Dataset CRC field for the associated subdivision/district in the Office Segment Poll (01021) message. Existing behavior has the on-board system ignore the Dataset CRC while the G BOS is in Synchronize mode for a subdivision/district. This behavior is extended to the IC3 Composite CRC. The on-board system ignores the Dataset CRC and the IC3 Composite CRC while the G BOS is in Synchronize mode for the associated subdivision/district.

The BOS and the IC3 may lose communication and/or the IC3 and a replicator may lose communication. A loss of communication between the BOS and the IC3 is a safe side failure. The G BOS waits to receive the IC3 Composite CRC from IC3 before issuing an Office Segment Poll (01021) message to the on-board system. After a configured time without receiving an Office Segment Poll (01021) message for a subdivision/district the on-board system sets the subdivision/district to "non-synchronized". A loss of communication between the IC3 and the replicator is a safe side failure. When the G BOS requests the IC3 Composite CRC from IC3, the IC3 still reports the CRC even if it may not have received all enforceable instructions. When the onboard system receives the Office Segment Poll (01021) message the on-board system detects a mismatch with the IC3 Composite CRC and become "non-synchronized" for the associated subdivision/district. The G BOS waits for the Individual MD CRC before issuing an enforceable instruction. During the communication outage between the IC3 and the replicator, the G BOS will be prevented from issuing enforceable instructions. Existing polling behavior results in a safe side failure. The G BOS has added an enforceable instruction to the Dataset CRC but is not allowed to issue it to a train without the Individual MD CRC. When the on-board system receives the next Office Segment Poll (01021) message the on-board system detects a mismatch with the Dataset CRC and becomes "non-synchronized".

Under certain circumstances, the BOS may detect invalid fields but continue to process the message and use the data within the message body. An invalid message in this may refer to when the data within the message body is not used. Note that message validation for the IC3 is less thorough than BOS message validation. The IC3 only validates the message integrity and the fields pertinent to generating the Individual MD CRCs and the IC3 Composite CRC. There are three scenarios associated with invalid or lost messages from Railroad Systems or on-board: both the G BOS and the IC3 do not receive a valid message, only the G BOS does not receive a valid message, and only the IC3 does not receive a valid message.

When both the G BOS and the IC3 do not receive a valid message neither segment uses the data within the message. Both segments continue to operate normally and the Dataset CRC is consistent with the IC3 Composite CRC. When the G BOS does not receive a valid message that the IC3 receives, the IC3 may use the data from the message but the G BOS does not. If the message is not pertinent to enforceable instructions and their association with trains there is no effect to the system. The IC3 does not use the message data. If the message is pertinent to enforceable instructions and their association with trains the IC3 Composite CRC may be inconsistent with the Dataset CRC for a subdivision/district for one or more trains. If the G BOS is not configured to transition to Synchronize or Stop mode due to the lost or invalid message, the on-board system may detect a mismatch with the IC3 Composite CRC and transition to "non-synchronized" for the subdivision/district. The on-board system sends the Poll Response (02021) message indicating the mismatch and causing G BOS to transition to Synchronize or Stop mode for the subdivision/district.

When the IC3 does not receive a valid message that the G BOS receives, the G BOS uses the data from the message but the IC3 does not. Because the G BOS has more thorough message validation the only likely reason for this is an error introduced in the messaging system between the replicator and the IC3. If the message is not pertinent to enforceable instruction and their association with trains, there is no effect to the system. If the message is pertinent to enforceable instructions and their association with trains the IC3 Composite CRC may be inconsistent with the Dataset CRC for a subdivision/district for one or more trains. The on-board system detects the IC3 Composite CRC mismatch, asks for another poll message, transitions to "non-synchronized" for the subdivision/district if the second poll message CRC mismatches, and sends the Poll Response (02021) message indicating the mismatch. The G BOS transitions to Synchronize or Stop mode for the subdivision/district.

The G BOS may request both the IC3 Individual MD CRC and the IC3 Composite CRC from IC3. It is possible that the IC3 is unresponsive or the interface between the two is not functioning properly. The G BOS initiates all exchanges with the IC3. When a valid response is not received, the G BOS retries requesting the desired CRC. The G BOS sends the request a configurable number of times after not receiving a valid response for a configurable time. When the G BOS has exhausted retries, the G BOS transitions to Stop mode for the associated subdivisions/districts. Without IC3 calculated CRCs, on-board system never becomes "synchronized" for any associated subdivision/district.

Another problem that may arise is that enforceable instructions may span subdivisions/districts. Each G BOS receives all enforceable instructions associated with the subdivisions/districts that it is configured to control. The IC3 also receives all enforceable instructions associated with the same set of subdivisions/districts. The IC3 does not contain the G BOS logic for determination of "async" G BOS, nor does the IC3 have a list of subdivisions/districts that G BOS controls, so the IC3 calculates and sends individual CRCs for each train and subdivision/district to the G BOS for every enforceable instruction that it receives. Because the IC3 receives the same set of enforceable instructions as G BOS, both the G BOS and the IC3 have the same set of enforceable instruction data. Spanning enforceable instructions also complicate the calculation of the Individual MD CRCs and IC3 Composite CRC. Accordingly, rules that enable consistent calculation under various spanning scenarios are provided.

In another preferred and non-limiting embodiment, the IC3 and/or the back office server, e.g., the G BOS, are configured or programmed to compare certain results and detect potential, existing, or imminent problems or issues prior to detection by the on-board system. For example, the enforceable instruction data or results for an enforceable instruction, e.g., the mandatory directive data or results for a mandatory directive, can be compared, where: (1) the G BOS and the IC3 compare a result when each enforceable instruction is received; (2) the G BOS and the IC3 compare the known set of enforceable instructions on a periodic basis; and/or (3) the G BOS and the IC3 compare a result before the Composite CRC is sent to the on-board system of the locomotive.

Figure 12:
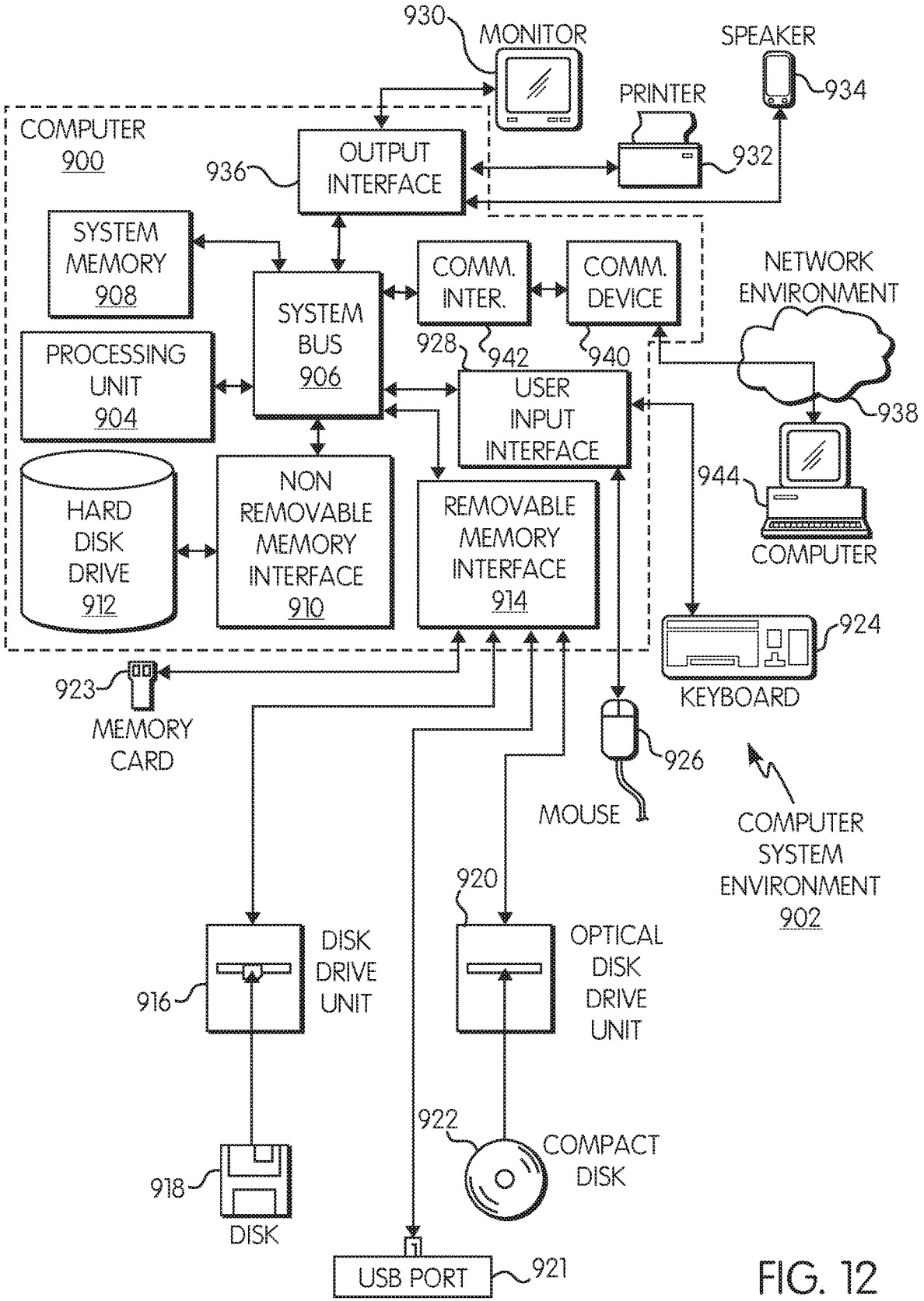
FIG. 12 illustrates a block diagram of a computer system according to principles of the present invention.

The present invention, as discussed above, may be implemented on a variety of computing devices, servers, processing units, and systems, wherein these computing devices, servers, processing units, and systems include the appropriate processing mechanisms and computer-readable media for storing and executing computer-readable instructions, such as programming instructions, code, and the like. As shown in FIG. 12, computers 900, 944, in a computing system environment 902 are provided. This computing system environment 902 may include, but is not limited to, at least one computer 900 having certain components for appropriate operation, execution of code, and creation and communication of data. For example, the computer 900 includes a processing unit 904 (typically referred to as a central processing unit or CPU) that serves to execute computer-based instructions received in the appropriate data form and format. Further, this processing unit 904 may be in the form of multiple processors executing code in series, in parallel, or in any other manner for appropriate implementation of the computer-based instructions.

In order to facilitate appropriate data communication and processing information between the various components of the computer 900, a system bus 906 is utilized. The system bus 906 may be any of several types of bus structures, including a memory bus or memory controller, a peripheral bus, or a local bus using any of a variety of bus architectures. In particular, the system bus 906 facilitates data and information communication between the various components (whether internal or external to the computer 900) through a variety of interfaces, as discussed hereinafter.

The computer 900 may include a variety of discrete computer-readable media components. For example, this computer-readable media may include any media that can be accessed by the computer 900, such as volatile media, non-volatile media, removable media, non-removable media, etc. As a further example, this computer-readable media may include computer storage media, such as media implemented in any method or technology for storage of information, such as computer-readable instructions, data structures, program modules, or other data, random access memory (RAM), read only memory (ROM), electrically erasable programmable read only memory (EEPROM), flash memory, or other memory technology, CD-ROM, digital versatile disks (DVDs), or other optical disk storage, magnetic cassettes, magnetic tape, magnetic disk storage, or other magnetic storage devices, or any other medium which can be used to store the desired information and which can be accessed by the computer 900. Further, this computer-readable media may include communications media, such as computer-readable instructions, data structures, program modules, or other data in other transport mechanisms and include any information delivery media, wired media (such as a wired network and a direct-wired connection), and wireless media. Computer-readable media may include all machine-readable media with the possible exception of transitory, propagating signals. Of course, combinations of any of the above should also be included within the scope of computer-readable media.

The computer 900 further includes a system memory 908 with computer storage media in the form of volatile and non-volatile memory, such as ROM and RAM. A basic input/output system (BIOS) with appropriate computer-based routines assists in transferring information between components within the computer 900 and is normally stored in ROM. The RAM portion of the system memory 908 typically contains data and program modules that are immediately accessible to or presently being operated on by processing unit 904, e.g., an operating system, application programming interfaces, application programs, program modules, program data and other instruction-based computer-readable codes.

With continued reference to FIG. 12, the computer 900 may also include other removable or non-removable, volatile or non-volatile computer storage media products. For example, the computer 900 may include a non-removable memory interface 910 that communicates with and controls a hard disk drive 912, i.e., a non-removable, non-volatile magnetic medium; and a removable, non-volatile memory interface 914 that communicates with and controls a magnetic disk drive unit 916 (which reads from and writes to a removable, non-volatile magnetic disk 918), an optical disk drive unit 920 (which reads from and writes to a removable, non-volatile optical disk 922, such as a CD ROM), a Universal Serial Bus (USB) port 921 for use in connection with a removable memory card, etc. However, it is envisioned that other removable or non-removable, volatile or non-volatile computer storage media can be used in the exemplary computing system environment 900, including, but not limited to, magnetic tape cassettes, DVDs, digital video tape, solid state RAM, solid state ROM, etc. These various removable or non-removable, volatile or non-volatile magnetic media are in communication with the processing unit 904 and other components of the computer 900 via the system bus 906. The drives and their associated computer storage media discussed above and illustrated in FIG. 12 provide storage of operating systems, computer-readable instructions, application programs, data structures, program modules, program data and other instruction-based computer-readable code for the computer 900 (whether duplicative or not of this information and data in the system memory 908).

A user may enter commands, information, and data into the computer 900 through certain attachable or operable input devices, such as a keyboard 924, a mouse 926, etc., via a user input interface 928. Of course, a variety of such input devices may be utilized, e.g., a microphone, a trackball, a joystick, a touchpad, a touch-screen, a scanner, etc., including any arrangement that facilitates the input of data, and information to the computer 900 from an outside source. As discussed, these and other input devices are often connected to the processing unit 904 through the user input interface 928 coupled to the system bus 906, but may be connected by other interface and bus structures, such as a parallel port, game port, or a universal serial bus (USB). Still further, data and information can be presented or provided to a user in an intelligible form or format through certain output devices, such as a monitor 930 (to visually display this information and data in electronic form), a printer 932 (to physically display this information and data in print form), a speaker 934 (to audibly present this information and data in audible form), etc. All of these devices are in communication with the computer 900 through an output interface 936 coupled to the system bus 906. It is envisioned that any such peripheral output devices be used to provide information and data to the user.

The computer 900 may operate in a network environment 938 through the use of a communications device 940, which is integral to the computer or remote therefrom. This communications device 940 is operable by and in communication to the other components of the computer 900 through a communications interface 942. Using such an arrangement, the computer 900 may connect with or otherwise communicate with one or more remote computers, such as a remote computer 944, which may be a personal computer, a server, a router, a network personal computer, a peer device, or other common network nodes, and typically includes many or all of the components described above in connection with the computer 900. Using appropriate communication devices 940, e.g., a modem, a network interface or adapter, etc., the computer 900 may operate within and communication through a local area network (LAN) and a wide area network (WAN), but may also include other networks such as a virtual private network (VPN), an office network, an enterprise network, an intranet, the Internet, etc. It will be appreciated that the network connections shown are exemplary and other means of establishing a communications link between the computers 900, 944 may be used.

As used herein, the computer 900 includes or is operable to execute appropriate custom-designed or conventional software to perform and implement the processing steps of the method and system of the present invention, thereby, forming a specialized and particular computing system. Accordingly, the presently-invented method and system may include one or more computers 900 or similar computing devices having a computer-readable storage medium capable of storing computer-readable program code or instructions that cause the processing unit 904 to execute, configure or otherwise implement the methods, processes, and transformational data manipulations discussed hereinafter in connection with the present invention. Still further, the computer 900 may be in the form of a personal computer, a personal digital assistant, a portable computer, a laptop, a palmtop, a mobile device, a mobile telephone, a server, or any other type of computing device having the necessary processing hardware to appropriately process data to effectively implement the presently-invented computer-implemented method and system.

Computer 944 represents one or more work stations appearing outside the local network and bidders and sellers machines. The bidders and sellers interact with computer 900, which can be an exchange system of logically integrated components including a database server and web server. In addition, secure exchange can take place through the Internet using secure www. An e-mail server can reside on system computer 900 or a component thereof. Electronic data interchanges can be transacted through networks connecting computer 900 and computer 944. Third party vendors represented by computer 944 can connect using EDI or www, but other protocols known to one skilled in the art to connect computers could be used.

The exchange system can be a typical web server running a process to respond to HTTP requests from remote browsers on computer 944. Through HTTP, the exchange system can provide the user interface graphics.

It will be apparent to one skilled in the relevant art(s) that the system may utilize databases physically located on one or more computers which may or may not be the same as their respective servers. For example, programming software on computer 900 can control a database physically stored on a separate processor of the network or otherwise.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims, of any. For example, it is to be understood that the present invention contemplates that, to the extent possible, one or more features of any embodiment can be combined with one or more features of any other embodiment.

What is claimed is:

1. A method comprising:

receiving, by a cyclic redundancy check (CRC) calculator, an enforceable instruction from a dispatch center, the enforceable instruction received in a first format;

converting, by the CRC calculator, the enforceable instruction from the dispatch center into a second format that is different than the first format;

calculating, by the CRC calculator, an enforceable instruction CRC based at least partly on the enforceable instruction from the dispatch center converted into the second format; and transmitting, by the CRC calculator, the enforceable instruction CRC in the second format to at least one of a back-office server of a vehicle control (VC) system or an on-board system of a vehicle.

2. The method of claim 1, wherein the enforceable instruction CRC is readable to the at least one of the back-office server or the on-board system of the vehicle in a different, third format.

3. The method of claim 1, wherein the CRC calculator is remote from the dispatch center and remote from the at least one of the back-office server or the on-board system of the vehicle.

4. The method of claim 1, further comprising:

receiving plural enforceable instructions from the dispatch center, each of the plural enforceable instructions being in the first format;

converting each of the plural enforceable instructions in the first format into the second format; and calculating a same number of plural enforceable instructions CRC as a number of the plural enforceable instructions, each of the plural enforceable instructions being in the second format.

5. The method of claim 1, wherein the CRC calculator is configured to transmit the enforceable instruction CRC to the at least one of the back-office server or the on-board system of the vehicle to confirm that the at least one of the back-office server or the on-board system of the vehicle receives correct instructions from the dispatch center.

6. The method of claim 1, further comprising calculating a composite enforceable instruction CRC based at least partly on the enforceable instruction from the dispatch center converted into the second format, and transmitting the composite enforceable instruction CRC to the at least one of the back-office server or the on-board system of the vehicle.

7. The method of claim 6, wherein the CRC calculator is configured to transmit the composite enforceable instruction CRC to the at least one of the back-office server or the on-board system of the vehicle to confirm that a target recipient of one of the at least one of the back-office server or the on-board system of the vehicle receives the composite enforceable instruction CRC.

8. The method of claim 1, wherein the enforceable instruction CRC comprises at least one of an authority data CRC, a bulletin data CRC, an authority void data CRC, or a bulletin void data CRC.

9. The method of claim 1, further comprising receiving a replicated message of the enforceable instruction from the dispatch center.

10. A system comprising:

a dispatch center configured to generate an enforceable instruction being in a first format;

a cyclic redundancy check (CRC) calculator communicatively coupled with the dispatch center, the CRC calculator configured to receive the enforceable instruction in the first format and convert the enforceable instruction from the first format into a second format that is different than the first format, wherein the CRC calculator is configured to generate an enforceable instruction CRC based at least in part on the enforceable instruction converted into the second format; and at least one of a back-office server of a vehicle control system or an on-board system of a vehicle communicatively coupled with the CRC calculator, wherein the CRC calculator is configured to transmit the enforceable instruction CRC in the second format to the at least one of the back-office server of the vehicle control system or the on-board system of the vehicle.

11. The system of claim 10, wherein the enforceable instruction CRC is readable to the at least one of the back-office server or the on-board system of the vehicle in a different, third format.

12. The system of claim 10, wherein the CRC calculator is remote from the dispatch center and remote from the at least one of the back-office server or the on-board system of the vehicle.

13. The system of claim 10, wherein the CRC calculator is configured to receive plural enforceable instructions from the dispatch center having the first format, convert each of the plural enforceable instructions in the first format into the second format, and calculate a same number of plural enforceable instructions CRC as a number of the plural enforceable instructions, each of the plural enforceable instructions being in the second format.

14. The system of claim 10, wherein the CRC calculator is configured to transmit the enforceable instruction CRC to the at least one of the back-office server or the on-board system of the vehicle to confirm that the at least one of the back-office server or the on-board system of the vehicle receives correct instructions from the dispatch center.

15. The system of claim 10, wherein the CRC calculator is configured to generate a composite enforceable instruction CRC based at least partly on the enforceable instruction from the dispatch center converted into the second format, and transmit the composite enforceable instruction CRC to the at least one of the back-office server or the on-board system of the vehicle.

16. The system of claim 15, wherein the CRC calculator is configured to transmit the composite enforceable instruction CRC to the at least one of the back-office server or the on-board system of the vehicle to confirm that a target recipient of one of the at least one of the back-office server or the on-board system of the vehicle receives the composite enforceable instruction CRC.

17. The system of claim 10, wherein the enforceable instruction CRC comprises at least one of an authority data CRC, a bulletin data CRC, an authority void data CRC, or a bulletin void data CRC.

18. A method comprising:

receiving an enforceable instruction from a dispatch center, the enforceable instruction received in a first format;

converting, by the CRC calculator, the enforceable instruction from the dispatch center into a second format that is different than the first format;

calculating an enforceable instruction CRC based at least partly on the enforceable instruction from the dispatch center converted into the second format; and transmitting, by the CRC calculator, the enforceable instruction CRC in the second format to at least one of a back-office server of a vehicle control (VC) system or an on-board system of a vehicle.

19. The method of claim 18, further comprising further comprising:

receiving plural enforceable instructions from the dispatch center, each of the plural enforceable instructions being in the first format;

converting each of the plural enforceable instructions in the first format into the second format; and calculating a same number of plural enforceable instructions CRC as a number of the plural enforceable instructions, each of the plural enforceable instructions being in the second format.

20. The method of claim 18, further comprising calculating a composite enforceable instruction CRC based at least partly on the enforceable instruction from the dispatch center converted into the second format, and transmitting the composite enforceable instruction CRC to the at least one of the back-office server or the on-board system of the vehicle.

* * * * *